US010408026B2

(12) United States Patent
Haley et al.

(10) Patent No.: US 10,408,026 B2
(45) Date of Patent: Sep. 10, 2019

(54) SYSTEM, APPARATUS, AND METHOD FOR WELL DELIQUIFICATION

(71) Applicant: Chevron U.S.A. Inc., San Ramon, CA (US)

(72) Inventors: Bart Aaron Haley, Lindale, TX (US); Jose A. Gamboa, Houston, TX (US); Gabriel Diaz, Houston, TX (US); Benjamin Francis Partington, Houston, TX (US); Jose Luis M. Arellano, Chicala (AO)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 15/727,081

(22) Filed: Oct. 6, 2017

(65) Prior Publication Data

US 2018/0045027 A1 Feb. 15, 2018

Related U.S. Application Data

(63) Continuation-in-part of application No. 14/464,221, filed on Aug. 20, 2014, now Pat. No. 9,816,367.
(Continued)

(51) Int. Cl.
*E21B 43/12* (2006.01)
*E21B 44/00* (2006.01)
*E21B 43/38* (2006.01)

(52) U.S. Cl.
CPC ..... *E21B 43/121* (2013.01); *E21B 43/38* (2013.01); *E21B 44/00* (2013.01)

(58) Field of Classification Search
CPC ..... E21B 43/121; E21B 43/34
See application file for complete search history.

(56) References Cited

U.S. PATENT DOCUMENTS 3,216,368 A 11/1965 Waldron
4,823,889 A * 4/1989 Baldenko ..... E21B 4/02 175/107
(Continued)

FOREIGN PATENT DOCUMENTS

CN 201074508 6/2008
CN 202832448 3/2013
(Continued)

OTHER PUBLICATIONS

Nair, J., et al.; "Downhole Venturi Nozzles and Foam Application: A Novel Artificial Lift Method"; SPE-173630-MS, (2015), pp. 1-14.
(Continued)

*Primary Examiner* — David J Bagnell
*Assistant Examiner* — Dany E Akakpo
(74) *Attorney, Agent, or Firm* — Karen R. DiDomenicis

(57) ABSTRACT

Embodiments for deliquification of produced fluid being produced from a well are provided. In one embodiment, a system comprises a production tubing, a casing, or both that receive the produced fluid from a subterranean reservoir and provide a pathway for transmission of the produced fluid to a surface location. The system also comprises a nozzle disposed within the production tubing, the casing, or both. The nozzle includes a passageway extending between an intake and a diffuser such that the produced fluid received by the intake flows through the nozzle via the passageway. The passageway includes a region of decreased cross-sectional area at a throat that reduces the pressure of the produced fluid passing through the nozzle and the produced fluid is deliquefied as it flows through the passageway. The system also comprises a sealer, a stopper, or both coupled to the nozzle to form a nozzle assembly.

26 Claims, 14 Drawing Sheets

Related U.S. Application Data

(60) Provisional application No. 62/405,620, filed on Oct. 7, 2016, provisional application No. 61/869,315, filed on Aug. 23, 2013.

(56) References Cited

U.S. PATENT DOCUMENTS

| | | | | |
|---|---|---|---|---|
| 5,083,429 | A | 1/1992 | Veres et al. | |
| 5,105,889 | A | 4/1992 | Misikov et al. | |
| 5,407,010 | A * | 4/1995 | Herschberger | E21B 43/122 166/372 |
| 5,752,570 | A | 5/1998 | Shaposhnikov et al. | |
| 5,893,414 | A | 4/1999 | Shaposhnikov et al. | |
| 5,967,234 | A | 10/1999 | Shaposhnikov et al. | |
| 6,357,530 | B1 * | 3/2002 | Kennedy | E21B 43/124 166/105.6 |
| 7,051,817 | B2 | 5/2006 | Shaposhnikov et al. | |
| 7,147,058 | B1 | 12/2006 | Shaposhnikov et al. | |
| 7,287,597 | B2 | 10/2007 | Shaposhnikov et al. | |
| 7,506,690 | B2 | 3/2009 | Kelley | |
| 7,610,818 | B2 | 11/2009 | Sanders et al. | |
| 7,793,727 | B2 | 9/2010 | Gaudette | |
| 7,806,186 | B2 | 10/2010 | Brown et al. | |
| 7,987,733 | B2 | 8/2011 | Atkinson et al. | |
| 8,122,966 | B2 | 2/2012 | Kelley | |
| 8,196,663 | B2 | 6/2012 | Bolding | |
| 8,469,103 | B2 | 6/2013 | Barry | |
| 8,550,158 | B1 | 10/2013 | Shaposhnikov | |
| 8,622,140 | B2 | 1/2014 | Falk et al. | |
| 9,062,538 | B2 | 6/2015 | Arellano et al. | |
| 9,353,614 | B2 * | 5/2016 | Roth | E21B 43/128 |
| 9,816,367 | B2 | 11/2017 | Arellano et al. | |
| 2004/0129428 | A1 | 7/2004 | Kelley | |
| 2006/0027372 | A1 | 2/2006 | Shaposhnikov et al. | |
| 2008/0319685 | A1 | 12/2008 | Xie et al. | |
| 2009/0321083 | A1 | 12/2009 | Schinagl | |
| 2010/0101798 | A1 | 4/2010 | Simpson et al. | |
| 2011/0155378 | A1 * | 6/2011 | Cabanilla | C09K 8/58 166/309 |
| 2012/0152399 | A1 | 6/2012 | Allinson et al. | |
| 2015/0053410 | A1 | 2/2015 | Arellano et al. | |
| 2015/0184806 | A1 | 7/2015 | Beg et al. | |
| 2015/0204150 | A1 * | 7/2015 | Churchill | E21B 41/0078 166/244.1 |

FOREIGN PATENT DOCUMENTS

| | | | |
|---|---|---|---|
| EA | 200201205 | | 6/2003 |
| EA | 201001876 | | 6/2011 |
| EP | 0247754 | | 10/1990 |
| GB | 2419905 | | 5/2006 |
| JP | 4298824 | B2 | 7/2009 |
| JP | 5589485 | B2 | 9/2014 |
| JP | 2015048981 | A | 3/2015 |
| RU | 2314859 | C2 | 1/2008 |
| RU | 2533318 | C2 | 11/2014 |
| RU | 6202099 | C1 | 11/2016 |
| WO | 1998/020231 | A1 | 5/1998 |
| WO | 2007/139541 | A1 | 12/2007 |
| WO | 2013/154222 | A1 | 10/2013 |
| WO | 2014/194729 | | 12/2014 |

OTHER PUBLICATIONS

International Search Report, dated Feb. 1, 2018, during the prosecution of International Application No. PCT/US2017/055613.

Written Opinion of the International Searching Authority, dated Feb. 1, 2018, during the prosecution of International Application No. PCT/US2017/055613.

Search Report, dated Oct. 7, 2014, during the prosecution of Great Britain Application No. 1414759.9.

White, Aaron; "Downhole Choke Applications & Performance Impact: *A Murphy Montney Evaluation*"; SPE-171598, Murphy Oil Company Ltd., pp. 1-37, date not provided.

White, Aaron, et al.; "Downhole Choke Applications & Performance Impact: *A Tupper Field Montney Evaluation*"; SPE-171598-MS, Murphy Oil Corp. Ltd., (Oct. 2014), pp. 1-24.

Tek, M. Rasin, et al.; "Temperature and Pressure Gradients in Gas Wells"; SPE 7495, (Oct. 1978), pp. 1-6 and Table 1.

* cited by examiner

SYSTEM, APPARATUS, AND METHOD FOR WELL DELIQUIFICATION

RELATED APPLICATIONS

This application claims the benefit of and priority to U.S. Provisional Application No. 62/405,620, filed Oct. 7, 2016, and entitled "System, Apparatus, and Method for Well Deliquification," which is incorporated herein by reference. This application also claims the benefit of and priority to U.S. Non-Provisional application Ser. No. 14/464,221, filed Aug. 20, 2014, and entitled "System, Apparatus and Method for Well Deliquification," which claims the benefit of and priority to U.S. Provisional Application No. 61/869,315, filed on Aug. 23, 2013, and entitled "System, Apparatus and Method for Well Deliquification," and both are incorporated herein by reference.

FIELD

The present disclosure is generally related to the production of fluids from a well and, more particularly, to deliquification of produced fluid being produced from a well by passing the produced fluid through a nozzle.

BACKGROUND

Fluids produced from wells often include multiple phases. For example, a conventional gas well can be used to produce hydrocarbon gases from a subterranean reservoir to a surface location. The reservoir where the gas is found may also contain liquids, such as water or hydrocarbon liquids. In a typical completion of a gas well, a tubular casing having one or more radial layers is disposed from the surface location to or through the reservoir. A production tube or tubing or string, typically a steel pipe, is disposed within the casing, typically with an annulus defined between the outside of the production tubing and the innermost well casing. At depth, in some embodiments, the outer surface of the production tubing is sealed to the inner surface of the casing by packers so that the production tubing provides a pathway from the reservoir to the surface location, and all produced fluid flowing through the well from the reservoir to the surface location flows through the production tubing. The casing is perforated to admit the produced fluid from the reservoir into the production tubing.

Gas and liquid that are present in the reservoir may enter the casing. During a typical operation of a gas well, the level of water or other liquids in the casing is below the inlet of the production tubing. Nevertheless, a phenomenon referred to as "liquid loading" of the produced gas may occur and the additional liquid may negatively impact production.

Even if the upper level of the liquid remains below the inlet of the production tubing, the gas may carry some liquid. In some cases, the liquid can be carried first in a gaseous phase, e.g., as water vapor, that liquefies as the produced fluid travels through the production tubing. As the vapor liquefies, it can form a mist, i.e., small droplets suspended in the gas. Mist-like droplets of the liquid can also be present in the gas as it enters the production tubing. In either case, the droplets of liquid typically tend to combine and form larger drops of liquid in the produced fluid. Thus, as the produced fluid travels through the production tubing, the liquid content may increase and may become more difficult to lift, thereby reducing the flow rate of the well. The liquid content in the produced fluid may even stop the production of gas from the well until sufficient pressure builds.

A number of conventional methods exist for deliquefying a produced fluid during production or otherwise increasing the flow rate of a gas producing well. Artificial lift can be provided to the well, such as by injecting a lift gas at high pressure into the annulus of the well so that the lift gas enters the production tubing at a particular depth and helps lift the produced fluid with it through the production tubing. Alternatively, a plunger- or rod-type pump can be used to draw gas from a well. Another conventional method includes injecting a diluent material or other chemical into the well to facilitate gaseous production.

While such conventional methods can be successful in facilitating production in some gas wells, there exists a continued need for improvements in the area of deliquification of produced fluids being produced from wells.

SUMMARY

Embodiments of a system for deliquification of produced fluid being produced from a well are provided herein. In one embodiment, the system comprises a production tubing, a casing, or both that receive the produced fluid from a subterranean reservoir and provide a pathway for transmission of the produced fluid to a surface location. The system also comprises a nozzle disposed within the production tubing, the casing, or both. The nozzle comprises an intake that defines an inlet, a throat proximate to the intake, and a diffuser proximate to the throat. The nozzle includes a passageway extending between the intake and the diffuser such that the produced fluid received by the intake flows through the nozzle via the passageway. The passageway includes a region of decreased cross-sectional area at the throat that reduces the pressure of the produced fluid passing through the nozzle and the produced fluid is deliquefied as it flows through the passageway. The system also comprises a sealer, a stopper, or both coupled to the nozzle to form a nozzle assembly.

Embodiments of an apparatus for deliquification of produced fluid being produced from a well are provided herein. In one embodiment, the apparatus comprises a nozzle for positioning in a production tubing, a casing, or both. The nozzle comprises an intake that defines an inlet, a throat proximate to the intake, and a diffuser proximate to the throat. The nozzle includes a passageway extending between the intake and the diffuser such that the produced fluid from a subterranean reservoir received by the intake flows through the nozzle via the passageway. The passageway includes a region of decreased cross-sectional area at the throat that reduces the pressure of the produced fluid passing through the nozzle and the produced fluid is deliquefied as it flows through the passageway. The diffuser of the nozzle has a conical shape, a bell shape, or a shape comprising a first section shaped in one of a conical shape or bell shape, and an adjoining second section shaped in a conical shape, bell shape, aerospike shape, or cylindrical shape with a constant inner diameter.

Embodiments of a method for deliquification of a produced fluid being produced from a well are provided herein. The method comprises providing a production tubing, a casing, or both extending from a subterranean reservoir to a surface location. The method also comprises providing a nozzle assembly. The nozzle assembly comprises a nozzle that comprises an intake that defines an inlet, a throat proximate to the intake, and a diffuser proximate to the throat. The nozzle includes a passageway extending between the intake and the diffuser such that the produced fluid received by the intake flows through the nozzle via the passageway. The passageway includes a region of decreased cross-sectional area at the throat that reduces the pressure of the produced fluid passing through the nozzle and the produced fluid is deliquefied as it flows through the passageway. The nozzle assembly also comprises a sealer, a stopper, or both coupled to the nozzle. The method also comprises receiving the produced fluid through the production tubing, the casing, or both along a pathway between the reservoir and the surface location such that the produced fluid passes through the nozzle.

Figure 1A:
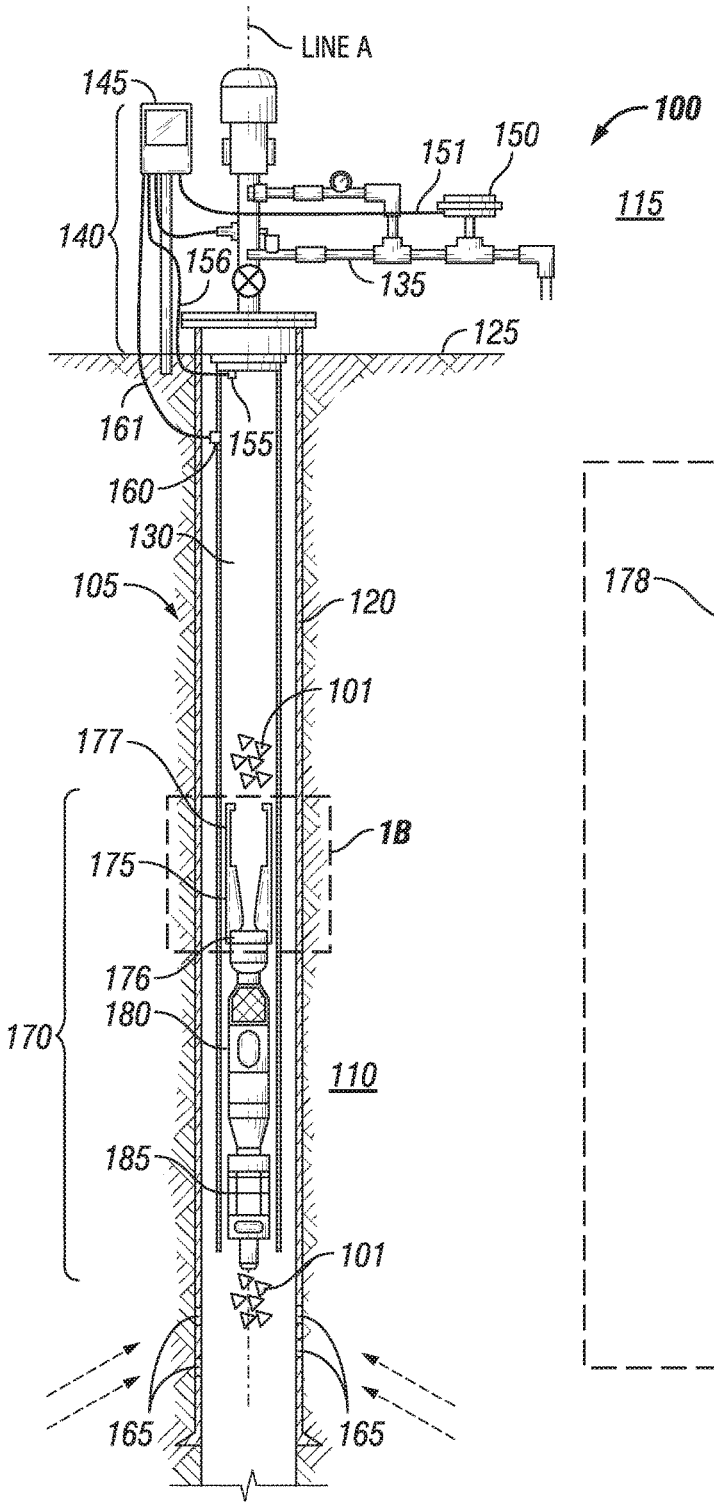
FIG. 1A illustrates one embodiment of a system for deliquefying produced fluid being produced from a well. The system of FIG. 1A includes a controller assembly and a nozzle assembly with three elements.

Figures are provided that illustrate various embodiments of systems, apparatuses, and methods of deliquefying produced fluid. The scope of the claims is not limited to the embodiments and figures provided with this disclosure.

DETAILED DESCRIPTION

Terminology

The following terms will be used throughout the specification and will have the following meanings unless otherwise indicated.

Hydrocarbon: The terms "hydrocarbon" or "hydrocarbonaceous" or "petroleum" or "crudes" or "oil" (and variants) may be used interchangeably to refer to carbonaceous material originating from subterranean formations as well as synthetic hydrocarbon products, including organic liquids or gases, kerogen, bitumen, crude oil, natural gas or from biological processes, that is principally hydrogen and carbon, with significantly smaller amounts (if any) of heteroatoms such as nitrogen, oxygen and sulfur, and, in some cases, also containing small amounts of metals. Crude oil (e.g., liquid petroleum) and natural gas (e.g., gaseous petroleum) are both hydrocarbons.

Hydrocarbon-bearing formation/Formation/Reservoir: The terms "hydrocarbon-bearing formation" or "formation" may be used interchangeably and refer to the hydrocarbon-bearing reservoir rock matrix in which at least one wellbore (e.g., an injection wellbore or a production wellbore) is present. For example, a formation refers to a body of hydrocarbon-bearing reservoir rock that is sufficiently distinctive and continuous such that it can be mapped. It should be appreciated that while the term "formation" generally refers to geologic formations of interest, that the term "formation," as used herein, may, in some instances, include any reservoirs, geologic points, zones, or volumes of interest (such as a survey area). The term formation is not limited to any structure and configuration described herein. The term formation may be used synonymously with the term reservoir.

Wellbore/Well: The term "wellbore" refers to a single hole drilled into a hydrocarbon-bearing formation for use in hydrocarbon recovery. The wellbore can be used for injection, production, or both. The wellbore may include casing, liner, tubing, other items, or any combination thereof. Casing is typically cemented into the wellbore with the cement placed in the annulus between the formation and the outside of the casing. The wellbore may include an open hole portion or uncased portion. The wellbore is surrounded by the formation. The wellbore may be vertical, inclined, horizontal, combination trajectories, etc. The wellbore may include any completion hardware that is not discussed separately. In some embodiments, the wellbore is a gas well for production of gas from reservoirs. In some embodiments, the wellbore may be a gas well for production of gas from reservoirs that include some liquids. The term wellbore is not limited to any structure and configuration described herein. The term wellbore may be used synonymously with the terms borehole or well. For simplicity, a "production wellbore" enables the removal (i.e., production) of fluids from the formation to the surface and an "injection wellbore" enables the placement (i.e., injection) of fluid into the formation from the surface.

Produced fluid: The term "produced fluid" refers to a fluid removed from a hydrocarbon-bearing formation via a wellbore. The produced fluid may include a brine or aqueous phase, but it may also include gas, such as a mixture of brine and gas. The produced fluid may include practically any material, liquid, gas, solid, etc. that is produced from the formation.

Equal: "Equal" refers to equal values or values within the standard of error of measuring such values. "Substantially equal" refers to an amount that is within 3% of the value recited.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained by the present invention, inclusive of the stated value and has the meaning including the degree of error associated with measurement of the particular quantity. This term "about" generally refers to a range of numbers that one of ordinary skill in the art would consider as a reasonable amount of deviation to the recited numeric values (i.e., having the equivalent function or result). For example, this term "about" can be construed as including a deviation of ±10 percent of the given numeric value provided such a deviation does not alter the end function or result of the value. Therefore, a value of about 1% can be construed to be a range from 0.9% to 1.1%.

As used in this specification and the following claims, the terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. Other variants of "comprise" may be "have" and "contain" and the like. For example, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Accordingly, these terms are intended to not only cover the recited element(s) or step(s), but may also include other elements or steps not expressly recited.

While various embodiments are described in terms of "comprising," "containing," or "including" various components or steps, the embodiments can also "consist essentially of" or "consist of" the various components and steps. "Consisting of" is closed, and excludes all additional elements. "Consisting essentially of" excludes additional material elements, but allows the inclusions of non-material elements that do not substantially change the nature of the invention.

Furthermore, as used herein, the use of the terms "a" or "an" when used in conjunction with an element may mean "one," but it is also consistent with the meaning of "one or more," "at least one," and "one or more than one." Thus, it is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items. As used herein, the use of "may" or "may be" indicates that a modified term is appropriate, capable, or suitable for an indicated capacity, function, or usage, while taking into account that in some circumstances the modified term may sometimes not be appropriate, capable, or suitable. Furthermore, unless explicitly dictated by the language, the term "and" may be interpreted as "or" in some instances.

It is understood that when combinations, subsets, groups, etc. of entities are disclosed (e.g., combinations of components in an item, or combinations of steps in a method), that while specific reference of each of the various individual and collective combinations and permutations of these entities may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components. For example, in some embodiments, the item described by this phrase could include only a component of type A. In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C. In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C). In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

All numbers and ranges disclosed above may vary by some amount. Whenever a numerical range with a lower limit and an upper limit is disclosed, any number and any included range falling within the range is specifically disclosed. Unless defined otherwise, all technical and scientific terms used herein have the same meanings as commonly understood by one of skill in the art to which the disclosed invention belongs. If there is any conflict in the usages of a word or term in this specification and one or more patent or other documents that may be incorporated herein by reference, the definitions that are consistent with this specification should be adopted.

This written description uses examples to disclose the invention, including the best mode, and also to enable any person skilled in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated by reference.

Provided herein are various embodiments of a nozzle alone and the nozzle in a nozzle assembly for deliquification of produced fluid. In some embodiments, the nozzle assembly includes two elements, such as the nozzle and a stopper coupled to the nozzle, or alternatively, the nozzle and a sealer coupled to the nozzle. In some embodiments, the nozzle assembly includes at least three elements, such as the nozzle, the sealer coupled to the nozzle, and the stopper coupled to the sealer. Each of the nozzle, the sealer, and the stopper includes a passageway to allow produced fluid to pass through that element. The nozzle may be disposed in production tubing of the well, casing of the well, or both. For example, if the well does not include production tubing, then the nozzle alone or nozzle assembly may be installed in the casing. Similarly, the nozzle assembly may be disposed in the production tubing of the well, the casing of the well, or both. A nozzle assembly may also include additional components. For example, the nozzle assembly may include one or more of a fishneck. For example, the nozzle assembly may include one or more of a pressure gauge. For example, the nozzle assembly may include one or more of a temperature gauge. For example, the nozzle assembly may include one or more of an extension. For example, the nozzle assembly may include one or more of a collar stop. For example, the nozzle assembly may include one or more of a cap extension. For example, the nozzle assembly may include one or more of a cage. For example, the nozzle assembly may include a fishneck, a pressure gauge, a temperature gauge, an extension, a collar stop, a cap extension, a cage, or any combination thereof.

In operation, in some embodiments, the produced fluid flows up through the stopper, then up through the sealer, then up through the nozzle, and then up to wellhead equipment at a surface location. Alternatively, in some embodiments, the produced fluid flows up through the stopper, then up through the nozzle, and then up to the wellhead equipment at the surface location. Alternatively, in some embodiments, the produced fluid flows up through the sealer, then up through the nozzle, and then up to the wellhead equipment at the surface location. Alternatively, in some embodiments, the produced fluid flows up through the nozzle, then up through the stopper, and then up to the wellhead equipment at the surface location. Alternatively, in some embodiments, the produced fluid flows up through the nozzle, then up through the sealer, and then up to the wellhead equipment at the surface location. Some embodiments may include a nozzle alone, not an entire nozzle assembly, and the produced fluid flows up through the nozzle and then up to the wellhead equipment at the surface location.

Nozzle:

Various embodiments are provided herein of a nozzle for use in the deliquification of produced fluid. For example, the nozzle may increase flow velocity of the produced fluid in order to unload liquid in the well, or at least reduce the critical gas rate of the well (e.g., when liquid loading is not yet present in the well). Furthermore, it is believed that the nozzle plays a role in the following two mechanisms for unloading liquid or avoiding liquid loading: (a) increase of gas velocity downstream of the nozzle due to gas expansion produced by pressure drop across the nozzle, and (b) atomization of liquid that causes more liquid to be entrained or transported by the gas phase to the surface location.

The nozzle includes an intake, a throat proximate to the intake, and a diffuser proximate to the throat. Each of the intake, the throat, and the diffuser may be manufactured with different characteristics, dimensions, and/or configurations, for example, depending on the specifics of the well. The intake is the inlet of the nozzle and the diffuser is the outlet of the nozzle. In some embodiments, the outer diameter of the nozzle may be constant (or substantially constant) throughout the length of the nozzle, but not in other embodiments. As an example, for installation in 3.5" production tubing or less, the outer diameter of the nozzle may be constant. However, the outer diameter of the nozzle may not be constant when installed in production tubing (or casing) having larger inner diameters, for example, to reduce weight of the nozzle and/or reduce material used in the nozzle.

Regarding the outer diameter and length of the nozzle, in some embodiments, the nozzle includes an outer diameter in a range of 1 inch to 6 inches. In some embodiments, the nozzle includes an outer diameter in a range of 2 inches to 5 inches. In some embodiments, the nozzle includes an outer diameter in a range of 3 inches to 4 inches. In some embodiments, the nozzle includes an outer diameter in a range of 2 inches to 3 inches. In some embodiments, the nozzle includes an outer diameter in a range of 1 inch to 4 inches. In some embodiments, the nozzle includes a length in a range of 3 inches to 5 feet. In some embodiments, the nozzle includes a length in a range of 3 inches to 3 feet. In some embodiments, the nozzle includes a length in a range of 6 inches to 2 feet. In some embodiments, the nozzle includes a length in a range of 10 inches to 2 feet. In some embodiments, the nozzle includes a length in a range of 10 inches to 18 inches. In one embodiment, the outer diameter of the nozzle may be 2.34 inches throughout the length of the nozzle and the length of the nozzle may be in a range of 12½ inches (e.g., with a 0.28" throat) to 15⅝ inches (e.g., with a 0.29" throat). In some embodiments, the length of the nozzle may depend on the inner diameter of the throat. The length of the nozzle may also depend heavily on the inner diameter of the production tubing or the casing. In some embodiments, the inner diameter of the production tubing or the casing may be in a range of 1.9 inches to 3.62 inches, or even larger in some embodiments. As an example, if the nozzle is upscaled for 5½" production tubing, the length of the nozzle could be several feet long. In some embodiments, the dimensions of the nozzle may be different than those stated herein, and the dimensions of the nozzle may ultimately depend on the diffuser of the nozzle, the throat of the nozzle, an expansion ratio discussed herein, the inner diameter of the production tubing, the inner diameter of the casing, or any combination thereof.

Turning to the intake of the nozzle, the intake allows the produced fluid to enter the nozzle from outside the nozzle, such as from the sealer, the stopper, the production tubing, the casing, etc. The intake includes an inner surface and provides a passageway for the produced fluid to enter the intake and flow from the intake to the throat that is proximate to the intake.

Turning to the inner diameter and length of the intake of the nozzle, in some embodiments, the inner diameter of the intake may not be constant throughout the length of the intake. For example, the inner diameter of the intake may go from a maximum inner diameter to a certain minimum inner diameter. In some embodiments, the minimum inner diameter of the intake and the inner diameter of the throat are equivalent, and the minimum inner diameter of the intake may be in a range of 0.15 inches to 0.75 inches. The inner diameter of the intake may be a number higher than the inner diameter of the throat at a distance farther away from the throat. In some embodiments, the inner diameter of the intake may be less than or equal to 5 inches. In some embodiments, the inner diameter of the intake may be in a range of 1.25 inches to 10 inches. In some embodiments, the length of the intake is shorter than the length of the diffuser. In some embodiments, the length of the intake may be in a range of 2 inches to 3 inches. In some embodiments, the length of the intake may be in a range of 2 inches to 2.5 inches. In some embodiments, the length of the intake may be less than or equal to 3 inches. In some embodiments, the length of the intake may be 2-25 inches. In some embodiments, the dimensions of the intake may be different than those stated herein, and the dimensions of the intake may ultimately depend on the diffuser of the nozzle, the throat of the nozzle, the expansion ratio discussed herein, the inner diameter of the production tubing, the inner diameter of the casing, or any combination thereof.

Turning to the throat of the nozzle, the throat is proximate to the intake. The inner diameter of the nozzle is the narrowest at the throat. In some embodiments, the throat of the nozzle is a toroidal throat. In some embodiments, the throat of the nozzle is a cylindrical throat. The throat includes an inner surface and provides a passageway for the produced fluid to enter the throat and flow to the diffuser that is proximate to the throat. For example, the passageway of the throat defines a region of decreased cross-sectional area of the nozzle to agitate the produced fluid passing through the throat due to the gas expansion discussed herein. Those of ordinary skill in the art will appreciate that practically any shape(s) may be used and the embodiments provided herein should not limit the scope of the disclosure.

Regarding the inner diameter and length of the throat of the nozzle, in some embodiments, the inner diameter of the throat may be in a range of 0.15 inches to 0.75 inches. In some embodiments, the inner diameter of the throat may be in a range of 0.25 inches to 0.50 inches. In some embodiments, the inner diameter of the throat may be in a range of 0.1 inches to 0.5 inches. In some embodiments, the inner diameter of the throat may be in a range of 0.30 inches to 0.40 inches. In some embodiments, the throat has an inner diameter of 0.375 inches. In some embodiments, the inner diameter at the throat may be more than or equal to 0.5 inches. In some embodiments, the inner diameter at the throat may be less than or equal to 1 inch. In some embodiments, the inner diameter of the throat is less than one-fifth of the inner diameter of the production tubing and/or the casing of the well, and, in some cases, less than one-tenth of the inner diameter of the production tubing and/or the casing of the well. For example, in one embodiment, if the production tubing has an inner diameter of 3.5 inches, the inner diameter defined by the throat may be between 0.1 inches and 0.5 inches, such as 0.35 inches in one embodiment or 0.3 inches to 0.4 inches in a second embodiment. Thus, for example, the region of decreased cross-sectional area of the nozzle may be the throat with the inner diameter being between 0.15 inches and 0.75 inches, may correspond to the throat with the inner diameter being less than one-fifth of the inner diameter of the production tubing and/or the casing, may correspond to the throat with the inner diameter being less than one-tenth of the inner diameter of the production tubing and/or the casing, or any combination thereof. The length of the throat may be approximately zero. However, the length of the throat may be less than or equal to 1 inch in one embodiment, less than or equal to 4 inches in a second embodiment, in a range of 0.1 inches to 3 inches in a third embodiment, and/or in a range of 0.3 inches to 1.5 inches in a fourth embodiment. In some embodiments, the dimensions of the throat may be different than those stated herein, and the dimensions of the throat may ultimately depend on the diffuser of the nozzle, the expansion ratio discussed herein, the inner diameter of the production tubing, the inner diameter of the casing, or any combination thereof.

Turning to the diffuser of the nozzle, the diffuser is proximate to the throat. The diffuser includes an inner surface and provides a passageway for the produced fluid to flow from the throat to the end of the diffuser. The passageway of the diffuser also allows the gas in the produced fluid to expand in a controlled manner. Gas expansion may cause agitation of the produced fluid. In some embodiments, the passageway of the diffuser may have a non-uniform cross-sectional area, for example, that smoothly increases in the flow direction.

Regarding the inner diameter and length of the diffuser of the nozzle, in some embodiments, the inner diameter of the diffuser may not be constant throughout the length of the diffuser as discussed hereinabove. For example, the inner diameter of the diffuser may go from a minimum, such as the inner diameter of the throat diameter, to a certain maximum inner diameter that is given by a certain expansion ratio. In some embodiments, the minimum inner diameter of the diffuser and the inner diameter of the throat are equivalent. In some embodiments, the minimum inner diameter of the diffuser may be in a range of 0.15 inches to 0.75 inches. Of course, the inner diameter of the diffuser may increase to a number higher than the inner diameter of the throat at a distance farther away from the throat, such as in a range of 1.25 inches to 5 inches. As such, the inner diameter of the diffuser may be in a range of 0.15 inches to 5 inches in one embodiment, in a range of 0.25 inches to 4 inches in a second embodiment, 0.5 inches to 3 inches in a third embodiment, less than or equal to 5 inches in fourth embodiment, and/or less than or equal to 3 inches in a fifth embodiment. The length of the diffuser may be in a range of 2 inches to 3 inches in some embodiments. The length of the diffuser may be less than or equal to 3 inches in some embodiments. The length of the diffuser may be in a range of more than or equal to 6 inches in some embodiments. The length of the diffuser may be less than or equal to 2.5 inches in some embodiments. In some embodiments, the length of the diffuser may be 2-25 inches. In some embodiments, the inner diameter and the length of the diffuser may depend on the particular expansion ratio sought, and the expansion ratio may be defined using at least one equation. Examples of the expansion ratio may be 1:2 in a first embodiment, 1:8 in a second embodiment, 1:12 in a third embodiment, or 1:20 in a fourth embodiment. Examples of the equation may be the following:

Isentropic Performance: Assuming that the process is adiabatic, isentropic, compressible fluid and there is no work across the control volume, the fluid velocity in any section of a Venturi nozzle is calculated as:

$$v_x = \sqrt{2\frac{p_0}{\rho_0}\frac{\kappa}{\kappa-1}\left(1-\left(\frac{p_x}{p_0}\right)^{\frac{\kappa-1}{\kappa}}\right)}$$

Mass flow rate is computed by the following formula:

$$\dot{m} = \rho_x A_x v_x$$

$$\dot{m} = \rho_x A_x \sqrt{2\frac{p_0}{\rho_0}\frac{\kappa}{\kappa-1}\left(1-\left(\frac{p_x}{p_0}\right)^{\frac{\kappa-1}{\kappa}}\right)}$$

Using isentropic relationships and assuming ideal gas, the previous equation may be written as:

$$\dot{m} = p_0 A_x \sqrt{2\frac{MW}{R_u T_0}\frac{\kappa}{\kappa-1}\left(\left(\frac{p_x}{p_0}\right)^{\frac{2}{\kappa}}-\left(\frac{p_x}{p_0}\right)^{\frac{\kappa+1}{\kappa}}\right)}$$

Thus, gas mass flow rate through the Venturi nozzle as a function of throat size is given by:

$$\dot{m} = p_0 A_t \sqrt{2\frac{MW}{R_u T_0}\frac{\kappa}{\kappa-1}\left(\left(\frac{p_t}{p_0}\right)^{\frac{2}{\kappa}}-\left(\frac{p_t}{p_0}\right)^{\frac{\kappa+1}{\kappa}}\right)}$$

Converting to field units:

$$\dot{m} = 1.098763 p_0 A_t \sqrt{\frac{\gamma_g}{T_0}\frac{\kappa}{\kappa-1}\left(\left(\frac{p_t}{p_0}\right)^{\frac{2}{\kappa}}-\left(\frac{p_t}{p_0}\right)^{\frac{\kappa+1}{\kappa}}\right)}$$

$\dot{m}$ = gas mass flow rate, $\frac{\text{lb}}{\text{s}}$ $A_t$ = cross sectional area of Venturi nozzle throat, $\text{in}^2$ $\kappa$ = heat capacity ratio $p_t$ = Absolute pressure of the gas at nozzle throat $p_0$ = Absolute stagnation pressure of the gas at nozzle inlet $T_0$ = Absolute stagnation temperature of the gas at nozzle inlet $\gamma_g$ = Gas specific gravity Using mass conservation principle can be demonstrated that:

$$\left(\left(\frac{p_t}{p_0}\right)^{\frac{2}{\kappa}}-\left(\frac{p_t}{p_0}\right)^{\frac{\kappa+1}{\kappa}}\right) = \left(\left(\frac{p_2}{p_0}\right)^{\frac{2}{\kappa}}-\left(\frac{p_2}{p_0}\right)^{\frac{\kappa+1}{\kappa}}\right)\left(\frac{A_2}{A_t}\right)^2$$

If the expansion ratio (ε) is defined as the area of the diffuser exit ($A_2$) divided by area of the throat ($A_t$), then:

$$\left(\left(\frac{p_t}{p_0}\right)^{\frac{2}{\kappa}}-\left(\frac{p_t}{p_0}\right)^{\frac{\kappa+1}{\kappa}}\right) = \left(\left(\frac{p_2}{p_0}\right)^{\frac{2}{\kappa}}-\left(\frac{p_2}{p_0}\right)^{\frac{\kappa+1}{\kappa}}\right)(\varepsilon)^2$$

The expansion ratio required is obtained once fluid reaches speed of sound at Venturi nozzle throat. This condition occurs when the following condition is satisfied:

$$\frac{p_t}{p_0} = \left(\frac{2}{k+1}\right)^{\frac{k}{k-1}}$$

Thus, the expansion ratio required to reach speed of sound for a given throat size may be estimated as:

$$\varepsilon = \left(\frac{2}{k+1}\right)^{\frac{\kappa+1}{2(\kappa-1)}}\left(\frac{k-1}{2}\right)^{\frac{1}{2}}\left(\frac{p_2}{p_0}\right)^{-\frac{1}{\kappa}}\left(1-\left(\frac{p_2}{p_0}\right)^{\frac{\kappa-1}{\kappa}}\right)^{-\frac{1}{2}}$$

Experiment results have demonstrated that mass flow rate predicted assuming an isentropic process differs from the actual mass flow rate. Discharge coefficient is then defined as:

$$C_D = \frac{\dot{m}_a}{\dot{m}}$$

Thus, the actual gas mass flow rate is estimated as:

$$\dot{m} = 1.098763 p_0 A_t C_D \sqrt{\frac{\gamma_g}{T_0}\frac{\kappa}{\kappa-1}\left(\left(\frac{p_t}{p_0}\right)^{\frac{2}{\kappa}}-\left(\frac{p_t}{p_0}\right)^{\frac{\kappa+1}{\kappa}}\right)}$$

The latter equation may be reorganized as follows:

$$\dot{m} = 1.098763\frac{p_0}{\sqrt{\frac{T_0}{\gamma_g}}} A_t C_D C_*$$

Where C* is defined as critical flow function for one-dimensional flow of a gas:

$$C_* = \sqrt{\frac{\kappa}{\kappa-1}\left(\left(\frac{p_t}{p_0}\right)^{\frac{2}{\kappa}}-\left(\frac{p_t}{p_0}\right)^{\frac{\kappa+1}{\kappa}}\right)}$$

This equation is similar than the one proposed in ISO 9300 for calculating the flow in critical flow venturi nozzles (CFVN). In some embodiments, the dimensions of the diffuser may be different than those stated herein, and the dimensions of the diffuser may ultimately depend the throat of the nozzle, the expansion ratio discussed herein, the inner diameter of the production tubing, the inner diameter of the casing, or any combination thereof.

The intake, the throat, and the diffuser may be coupled together, for example, by threading or welding, to form the nozzle. Alternatively, the nozzle may be formed with the intake, the throat, and the diffuser as integral members of the nozzle. The nozzle with the intake, the throat, and the diffuser may resemble a convergent-divergent nozzle. More specifically, the nozzle provided herein allows the produced fluid to reach its maximum speed (speed of sound). For example, at the time of filing, it is believed that the speed of sound is reached at the throat, but the produced fluid is deaccelerated at the diffuser. At the time of filing, it is further believed that this change of produced fluid velocity may be used to recover part of the pressure lost at the throat. At the time of filing, it is further believed that the nozzle provided herein allows the produced fluid to reach critical flow (speed of sound at the throat) at lower pressure drop than chokes or other flow restriction devices. Moreover, in some embodiments, the diffuser of the nozzle has a conical shape and therefore the nozzle may be considered to be a convergent-divergent conical nozzle. In some embodiments, the diffuser of the nozzle has a bell shape and therefore the nozzle may be considered to be a convergent-divergent bell nozzle. In some embodiments, the diffuser of the nozzle has a double bell shape and therefore the nozzle may be considered to be a convergent-divergent double bell nozzle. In some embodiments, the diffuser of the nozzle has a bell with aerospike shape and therefore the nozzle may be considered to be a convergent-divergent bell with aerospike nozzle. The aerospike may also be referred to as an afterburner.

A tool engagement segment may also be located proximate to the intake, proximate to the diffuser, or both. As an example, a first tool engagement segment may be integral or otherwise coupled with the nozzle for coupling the nozzle to a tool, such as the sealer or the stopper. In some embodiments, the first tool engagement segment may even be used for coupling the nozzle to a different tool, like a wireline tool. The first tool engagement segment may include threads or other components for coupling the first tool engagement segment to a tool. The threads may be consistent with a 1-3/4-12UN-2B thread specification (1" long) in some embodiments. The threads may be consistent with 1.375-10 STUB ACME threads (also 1" long) in some embodiments. In some embodiments, the first tool engagement segment may be proximate to the intake.

The first tool engagement segment also includes an inner surface and may provide a passageway for produced fluid to enter one end of the first tool engagement segment and flow to the intake of the nozzle. In some embodiments, the passageway of the first tool engagement segment may have a constant (or substantially constant) cross-sectional area. For example, the inner diameter of the first tool engagement segment may be constant or substantially constant along the length of the first tool engagement segment. In some embodiments, the first tool engagement segment has an inner diameter of less than or equal to 5 inches. In some embodiments, the first tool engagement segment has an inner diameter of less than or equal to 3 inches. In some embodiments, the first tool engagement segment has an inner diameter in a range of 1 inch to 4 inches. In some embodiments, the first tool engagement segment has a length of less than or equal to 5 inches. In some embodiments, the first tool engagement segment has a length in a range of 2 inches to 4 inches. In some embodiments, the first tool engagement segment has a length of less than or equal to 3 inches. In some embodiments, the first tool engagement segment has an inner diameter in a range of 1.4 inches to 5 inches and a length in a range of 1 inch to 5 inches. In some embodiments, the first tool engagement segment has an inner diameter in a range of 1.4 inches to 2.8 inches and a length in a range of 1 inch to 5 inches. For example, the first tool engagement segment may have an inner diameter in a range of 1.4 inches to 5 inches and a length in a range of 1 inch to 5 inches for a 3½" nozzle. In some embodiments, the dimensions of the first tool engagement segment may depend on the dimensions of the nozzle (or parts thereof such as the intake), the production tubing, the casing, or any combination thereof.

A second tool engagement segment may be integral or otherwise coupled with the nozzle for coupling the nozzle to a tool, like a wireline tool. In some embodiments, the second tool engagement segment may even be used for coupling the nozzle to a different tool, such as the sealer or the stopper. In some embodiments, the second tool engagement segment may be proximate to the diffuser. The second tool engagement segment may include a fishneck. The second tool engagement segment may include at least one lip, for example, as part of the fishneck. The lip may be a cylindrical lip. The fishneck allows a tool, such as the wireline tool, to engage the inside of the second tool engagement segment in order to lower the nozzle, set the nozzle, and retrieve the nozzle. In the case of the nozzle assembly, the fishneck allows the tool, such as the wireline tool, to engage the inside of the second tool engagement segment in order to lower the nozzle assembly, set the nozzle assembly, and retrieve the nozzle assembly. The fishneck may be an internal type fishing neck or an external type of fishing neck. For example, the external fishneck used may be compatible with commercially available JD or JU Pulling tools.

The second tool engagement segment also includes an inner surface and may provide a passageway for produced fluid to flow from the diffuser into the second tool engagement segment and flow to one end of the second tool engagement segment. In some embodiments, the passageway of the second tool engagement segment may have a constant (or substantially constant) cross-sectional area. For example, the inner diameter of the second tool engagement segment may be constant (or substantially constant) along the length of the fishneck. In some embodiments, the fishneck has an inner diameter in a range of 1 inch to 5 inches and a length in a range of 4 inches to 5 inches. In some embodiments, the inner diameter of the fishneck may be larger when the inner diameter of the production tubing or the casing is larger. In some embodiments, the fishneck has an inner diameter of 1.56 inches, for example, when the inner diameter of the production tubing or the casing is 2⅞ inches. In some embodiments, the fishneck has an inner diameter of 1.25 inches, for example, when the inner diameter of the production tubing or the casing is 2⅞ inches. The length may vary, but the length of the fishneck should be long enough to receive and engage with the tool, such as the wireline tool. In some embodiments, the length of the fishneck may be 4.312 inches when the inner diameter of the production tubing or the casing is 2⅞ inches. In some embodiments, the inner diameter of the lip is in a range of 1.38 inches. In some embodiments, the lip has a length in a range of 0.315 inches to 0.385 inches. In some embodiments, the entire second tool engagement segment may have an inner diameter in a range of less than or equal to 2 inches. In some embodiments, the entire second tool engagement segment may have an inner diameter in a range of less than or equal to 1.5 inches. In some embodiments, the entire second tool engagement segment may have a length in a range of less than or equal to 5.5 inches. In some embodiments, the entire second tool engagement segment may have a length in a range of 4.2 inches to 5 inches. In some embodiments, the entire second tool engagement segment, including the fishneck and the lip, may have an inner diameter in a range of 0.38 inches to 1.13 inches and the length may be in a range of 4.2 inches to 5.5 inches. In some embodiments, the dimensions of the second tool engagement segment may depend on the dimensions of the nozzle (or parts thereof such as the diffuser), the production tubing, the casing, or any combination thereof.

Those of ordinary skill in the art will appreciate that various modifications may be made to the provided embodiment. For example, some embodiments may include a continuous inner surface extending through the first tool engagement segment (if any), the intake, the throat, the diffuser, and the second tool engagement segment (if any). Similarly, some embodiments may include a continuous passageway extending through the first tool engagement segment (if any), the intake, the throat, the diffuser, and the second tool engagement segment (if any). Furthermore, FIGS. 12A-12G illustrate various embodiments of the first tool engagement segment, the intake, the throat, the diffuser, and the second tool engagement segment, but these embodiments are not meant to limit the scope of the disclosure.

Figure 12A:
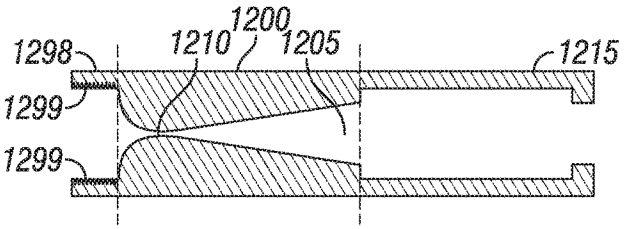
FIGS. 12A-12G illustrate various embodiments of the first tool engagement segment, the intake, the throat, the diffuser, and the second tool engagement segment.

FIG. 12A illustrates one embodiment of a nozzle 1200 with a diffuser 1205 having a conical shape, such as an embodiment of a convergent-divergent conical nozzle. In FIG. 12A, the inner diameter of the diffuser 1205 with the conical shape may increase continuously from a throat 1210 to the beginning of a second tool engagement segment 1215. In some embodiments, the inner diameter of the diffuser 1205 with the conical shape may be in a range of 1 inch to 5 inches. The minimum inner diameter of the diffuser 1205 may be the inner diameter of the throat 1210. In some embodiments, the inner diameter of the diffuser 1205 may depend on the inner diameter of the production tubing or the casing in which the nozzle 1200 will be installed. For example, the inner diameter of the diffuser 1205 may be larger when the nozzle 1200 with be installed in production tubing, casing, or both having larger inner diameters, and so on.

Figure 12B:
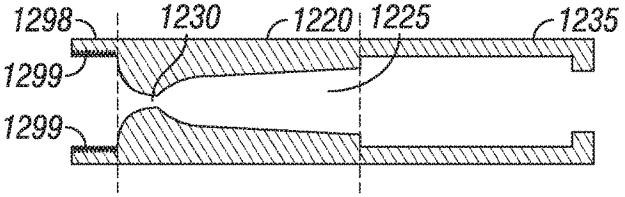
Figure 12C:
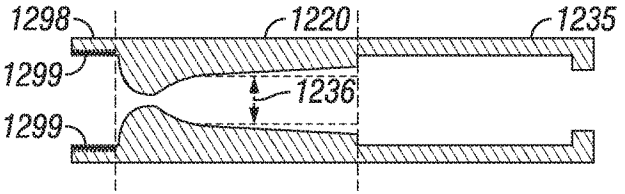

FIG. 12B illustrates one embodiment of a nozzle 1220 with a diffuser 1225 having a bell shape, such as an embodiment of a convergent-divergent bell nozzle. In FIG. 12B, the inner diameter of the diffuser 1225 with the bell shape may increase continuously from a throat 1230 to the beginning of a second tool engagement segment 1235. In some embodiments, the inner diameter of the diffuser 1225 with the bell shape may be in a range of 1 inch to 5 inches. The minimum inner diameter of the diffuser 1225 may be the inner diameter of the throat 1230. In some embodiments, the inner diameter of the diffuser 1225 may depend on the inner diameter of the production tubing or the casing in which the nozzle 1220 will be installed. In some embodiments, the inner diameter of the diffuser 1225 with the bell shape may include a portion of constant inner diameter, for example, as illustrated by dash lines 1236 in FIG. 12C.

Figure 12D:
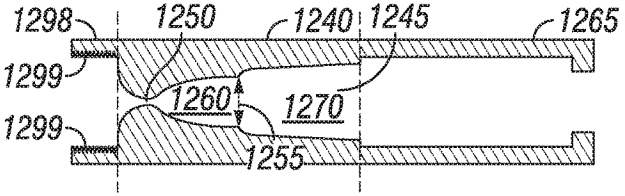
Figure 12E:
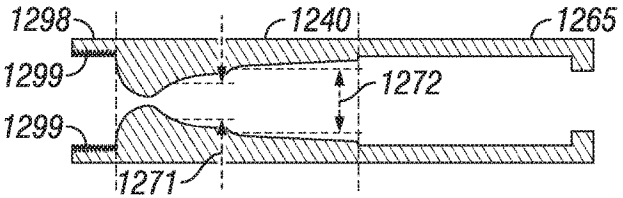

FIG. 12D illustrates one embodiment of a nozzle 1240 with a diffuser 1245 having a double bell shape, such as an embodiment of a convergent-divergent double bell nozzle. In FIG. 12D, the inner diameter of the diffuser 1245 with the double bell shape may increase continuously from a throat 1250 to a first location 1255 (i.e., a bell 1260 proximate to the throat 1250) and then increase continuously from a first location 1255 to the beginning of a second tool engagement segment 1265 (i.e., a bell 1270 proximate to the second tool engagement segment 1265). In some embodiments, the inner diameter of the diffuser 1245 with the double bell shape may be in a range of 1 inch to 5 inches. The minimum inner diameter of the diffuser 1245 may be the inner diameter of the throat 1250. In some embodiments, the inner diameter of the diffuser 1245 may depend on the inner diameter of the production tubing or the casing in which the nozzle 1240 will be installed. In some embodiments, the inner diameter of the diffuser 1245 with the double bell shape may include a portion of constant inner diameter, for example, as illustrated by dash lines 1271, 1272 in FIG. 12E. In FIG. 12E, each bell is illustrated with a constant portion, but in some embodiments, all of the bells do not include a constant portion.

Regarding the double bell shape, in some embodiments, the bell 1260 proximate to the throat 1250 may be 95% or less of the diffuser 1245. In some embodiments, the bell 1260 proximate to the throat 1250 may be 85% or less of the diffuser 1245. In some embodiments, the bell 1260 proximate to the throat 1250 may be 75% or less of the diffuser 1245. In some embodiments, the bell 1260 proximate to the throat 1250 may be 65% or less of the diffuser 1245. In some embodiments, the bell 1260 proximate to the throat 1250 may be 55% or less of the diffuser 1245. In some embodiments, the bell 1260 proximate to the throat 1250 may be 45% or less of the diffuser 1245. In some embodiments, the bell 1260 proximate to the throat 1250 may be 35% or less of the diffuser 1245. In some embodiments, the bell 1260 proximate to the throat 1250 may be 25% or less of the diffuser 1245. In some embodiments, the bell 1260 proximate to the throat 1250 may be 15% or less of the diffuser 1245. In some embodiments, the bell 1260 proximate to the throat 1250 may be 10% to 80% of the diffuser 1245. In some embodiments, the bell proximate 1260 to the throat 1250 may be 20% to 70% of the diffuser 1245. In some embodiments, the bell 1260 proximate to the throat 1250 may be 30% to 60% of the diffuser 1245. In some embodiments, the bell 1260 proximate to the throat 1250 may be 40% to 50% of the diffuser 1245. In some embodiments, the bell 1260 proximate to the throat 1250 may be 5% to 50% of the diffuser 1245. It is also contemplated that some embodiments may include more than two bells in the diffuser 1245, such as three bells, four bells, etc. Furthermore, in some embodiments, a non-bell shape may be included between two bells in the diffuser 1245.

Figure 12F:
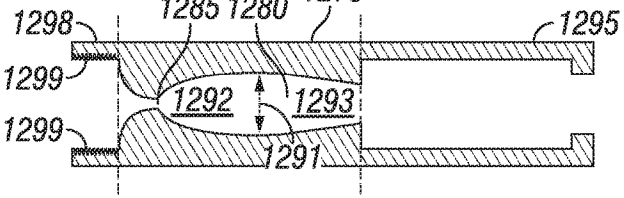
Figure 12G:
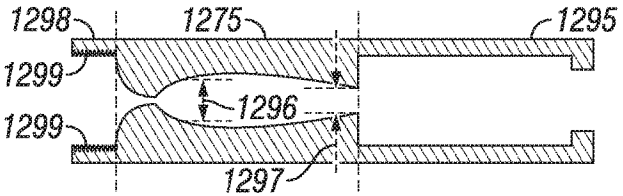

FIG. 12F illustrates one embodiment of a nozzle 1275 with a diffuser 1280 having a bell with an areospike shape, such as an embodiment of a convergent-divergent bell with areospike nozzle. In FIG. 12F, the inner diameter of the diffuser 1280 with the bell with the areospike shape may increase continuously from a throat 1285 to a first location 1291 (i.e., a bell 1292 proximate to the throat 1285) and then decrease continuously from the first location 1291 to the beginning of a second tool engagement segment 1295 (i.e., an areospike 1293 proximate to the second tool engagement segment 1295). In some embodiments, the inner diameter of the diffuser 1280 with the bell with the areospike shape may be in a range of 1 inch to 5 inches. In some embodiments, the inner diameter of the diffuser 1280 with the bell with the aerospike shape may include a portion of constant inner diameter, for example, as illustrated by dash lines 1296, 1297 in FIG. 12G. In FIG. 12G, the bell 1292 proximate to the throat 1285 is illustrated with a portion of constant inner diameter and the areospike 1293 is illustrated with a portion of constant inner diameter, but embodiments may differ. For example, only the bell 1292 has a portion of constant inner diameter in a first embodiment, only the areospike 1293 has a portion of constant inner diameter in a second embodiment, or both the bell 1292 and the areospike 1293 have a portion of constant inner diameter in a third embodiment.

Regarding the bell with areospike shape, in some embodiments, the bell 1292 proximate to the throat 1285 may be 95% or less of the diffuser 1280. In some embodiments, the bell 1292 proximate to the throat 1290 may be 85% or less of the diffuser 1280. In some embodiments, the bell 1292 proximate to the throat 1285 may be 75% or less of the diffuser 1280. In some embodiments, the bell 1292 proximate to the throat 1285 may be 65% or less of the diffuser 1280. In some embodiments, the bell 1292 proximate to the throat 1285 may be 55% or less of the diffuser 1280. In some embodiments, the bell 1292 proximate to the throat 1285 may be 45% or less of the diffuser 1280. In some embodiments, the bell 1292 proximate to the throat 1285 may be 35% or less of the diffuser 1280. In some embodiments, the bell 1292 proximate to the throat 1285 may be 25% or less of the diffuser 1280. In some embodiments, the bell 1292 proximate to the throat 1285 may be 15% or less of the diffuser 1280. In some embodiments, the bell 1292 proximate to the throat 1285 may be 10% to 80% of the diffuser 1280. In some embodiments, the bell 1292 proximate to the throat 1285 may be 20% to 70% of the diffuser segment 1280. In some embodiments, the bell 1292 proximate to the throat 1285 may be 30% to 60% of the diffuser 1280. In some embodiments, the bell 1292 proximate to the throat 1285 may be 40% to 50% of the diffuser 1280. In some embodiments, the bell 1292 proximate to the throat 1285 may be 5% to 50% of the diffuser 1280. It is also contemplated that some embodiments may include a plurality of bells in the diffuser 1280, such as two bells, etc. It is also contemplated that some embodiments may include a plurality of areospikes 1293 in the diffuser 1280, such as two areospikes, etc. Furthermore, in some embodiments, a non-bell shape may be included between the bell 1292 proximate to the throat 1285 and the areospike 1293 in the diffuser 1280.

In each of the embodiments illustrated in FIGS. 12A-12G, an intake 1298 is illustrated with threads 1299 and with a substantially constant inner diameter. Furthermore, in each of FIGS. 12A-12G, the second tool engagement segment 1215, 1235, 1265, 1295 include a fishneck and a cylindrical lip, as well as a constant inner diameter within the fishneck and between the cylindrical lip.

Of course, those of ordinary skill in the art will appreciate that various modifications may be made to the embodiments provided herein. For example, the nozzle 1200 of FIG. 12A may include at least one portion of constant inner diameter in the diffuser 1205, at least one bell in the diffuser 1205, at least one areospike in the diffuser 1205, or any combination thereof. Furthermore, the use of the terminology "first tool engagement segment" and "second tool engagement segment" is merely used for ease of understanding, and as will be more evident, for example, in the context of FIG. 4A, the first tool engagement segment or second tool engagement segments may be proximate to the diffuser of the nozzle in some embodiments. Similarly, the first tool engagement segment or second tool engagement segments may be proximate to the intake of the nozzle in some embodiments.

Sealer:

Embodiments of the disclosure include a sealer disposed in the production tubing or the casing. The purpose of the sealer is to reduce, or prevent, the produced fluid from flowing around the nozzle. In other words, the sealer ensures that the produced fluid flows through the sealer and then flows to the nozzle directly or via the first tool engagement segment. The sealer may include threads or other mechanism for coupling to the tool engagement segment. For example, once a shear pin is broken, the upper part of the sealer may be pushed down into an elastomer that forces it outwards towards the inner surface of the production tubing or the casing such that the outer surface of the sealer contacts the inner surface of the production tubing or the casing.

The sealer includes an inner surface and provides a passageway extending from one end of the sealer to the other end of the sealer. In some embodiments, the passageway of the sealer may have a constant (or substantially constant) cross-sectional area, but not in other embodiments. For example, the inner diameter of the sealer may be constant (or substantially constant) along the length of the sealer. In some embodiments, the sealer has an inner diameter of less than or equal to 5 inches in one embodiment, of less than or equal to 3 inches in second embodiment, in a range of 1 inch to 3 inches in a third embodiment, and/or in a range of 2 inches to 4 inches in a fourth embodiment. In some embodiments, the sealer has an outer diameter of less than or equal to 6 inches in one embodiment, of less than or equal to 4 inches in second embodiment, in a range of 1.5 inches to 3.5 inches in a third embodiment, and/or in a range of 1.5 inches to 5 inches in a fourth embodiment. In some embodiments, the sealer has a length of less than or equal to 15.5 inches in one embodiment, of less than or equal to 12 inches in second embodiment, in a range of 15.5 inches to 30 inches in a third embodiment, and/or in a range of 8 inches to 12 inches in a fourth embodiment. In some embodiments, the sealer has an inner diameter in a range of 0.5 inches to 5 inches, an outer diameter in a range of 1.85 inches to 6 inches, and a length in a range of 8 inches to 30 inches.

In some embodiments, the sealer comprises a packer, a packoff tool, or any combination thereof. For example, the packer may be used for large production tubing sizes, such as 5½" tubing. Examples of commercially available sealers that may be used include the IPS Multi-Stage Packoff tool which is an example of a packoff tool, the Halliburton BB Wireline-Retrievable Packer which is an example of a packer, etc. In some embodiments, the dimensions of the sealer may depend on the dimensions of the nozzle (or parts thereof), the tool engagement segment (e.g., the first tool engagement segment proximate to the intake of the nozzle), the production tubing, the casing, or any combination thereof.

Stopper:

Embodiments of the disclosure include a stopper disposed in the production tubing or the casing. The purpose of the stopper is to hold the nozzle in place. For example, the stopper may hold the nozzle in place when the nozzle is coupled to the stopper via a tool engagement segment. The stopper may include threads or other mechanism for coupling to the tool engagement segment. The stopper may also hold the sealer in place when the sealer is coupled to the nozzle via the first tool engagement segment. The outer surface of the stopper contacts the inner surface of the production tubing or the casing by engaging a slip cone which slips to contact the walls of the production tubing or the casing, holding the device in place with friction. Alternatively, the stopper may engage the recesses of the tubing. The stopper may also include threads or other mechanism for coupling to the tool engagement segment.

The stopper includes an inner surface and provides a passageway extending from one end of the stopper to the other end of the stopper. In some embodiments, the passageway of the stopper may have a constant (or substantially constant) cross-sectional area, but not in other embodiments. For example, the inner diameter of the stopper may be constant (or substantially constant) along the length of the stopper. In some embodiments, the stopper has an inner diameter of less than or equal to 5 inches in one embodiment, of less than or equal to 3 inches in a second embodiment, in a range of 1 inch to 3 inches in a third embodiment, and/or in a range of 2 inches to 4 inches in a fourth embodiment. In some embodiments, the stopper has an outer diameter of less than or equal to 5.5 inches in one embodiment, of less than or equal to 4 inches in second embodiment, in a range of 1.5 inches to 3.5 inches in a third embodiment, and/or in a range of 2 inches to 5 inches in a fourth embodiment. In some embodiments, the sealer has a length of less than or equal to 48 inches in one embodiment, of less than or equal to 36 inches in second embodiment, in a range of 5 inches to 36 inches in a third embodiment, in a range of 12 inches to 30 inches in a fourth embodiment, and/or in a range of 10 inches to 40 inches in a fifth embodiment. In some embodiments, the stopper has an inner diameter in a range of 1 inch to 5 inches, an outer diameter in a range of 1.5 inches to 5.5 inches, and a length in a range of 5 inches to 48 inches.

In some embodiments, the stopper comprises a collar stop, a tubing stop, a hold down cup, a locking tool, or any combination thereof. Examples of commercially available sealers that may be used include the IPS Multi Stage Tool, etc. In some embodiments, the dimensions of the stopper may depend on the dimensions of the nozzle (or parts thereof), the tool engagement segment (e.g., the first tool engagement segment proximate to the intake of the nozzle), the production tubing, the casing, or any combination thereof. In some embodiments, if a hold down cup is included, then no sealer is used.

Installation:

At least one nozzle (as discussed herein with the inlet, the throat, and the diffuser) may be removably disposed in the production tubing or the casing in some embodiments. For example, the nozzle may be positioned in the production tubing or the casing at a desired location by engaging the tool engagement segment (e.g., proximate to the diffuser of the nozzle) with the wireline tool by frictional fit or mechanical connection. As discussed hereinabove, the wireline tool engages the fishneck and the lip of the tool engagement segment in order to interact with the nozzle. Examples of commercially available wireline tools that may be used include the Halliburton GS Series Setting tool, the Schlumberger JD Series setting tool, etc.

The nozzle may be disposed in a particular position in the casing of the well, and the well does not include any production tubing. The nozzle may be disposed in a particular position in the casing of the well that does not include the production tubing, but the well does include production tubing in other portions of the well. The nozzle may be disposed in a position in the production tubing, and the production tubing is within the casing. For example, the nozzle may be disposed in the production tubing before or after the production tubing is inserted into the well. As another example, with the production tubing in place in the well, the nozzle may be lowered into the production tubing using the wireline tool until the nozzle is at a desired location. The wellhead equipment may be kept in place when the wireline tool is used, but the wellhead equipment may have to be uninstalled in some instances when the wireline tool is not used. Nonetheless, after the wireline tool has been used to dispose the nozzle in its desired position, the wireline tool may be disengaged from the tool engagement segment and removed, leaving the nozzle in place.

Of note, the nozzle may include connection members on the outer surface of the nozzle to facilitate the engagement of the nozzle with the inner surface of the production tubing or the casing as described in U.S. Patent Publication No. 2015/0053410A1, which is incorporated herein by reference in its entirety. For example, the connection members may comprise a nitrite ring, a metal slip, etc. to hold the nozzle in place. The connection members may be engaged or disengaged from the inner surface of the production tubing or the casing by pulling with slick line or jar down to lock the nozzle.

In some instances, it may also be desirable to move or remove the nozzle from the production tubing or the casing. For example, after production of the well, the conditions of the well may change, the understanding of the well conditions may improve, and/or the nozzle or other components may be damaged or worn. In such cases, the wireline tool may be inserted into the production tubing or the casing to engage the tool engagement segment (e.g., proximate to the diffuser of the nozzle) so that the wireline tool may be used to either move the nozzle to a different location in the production tubing or the casing, or alternatively, to remove the nozzle from the production tubing or the casing.

Similarly, in some embodiments, at least one nozzle assembly (as discussed herein with the nozzle as well as the sealer, the stopper, or both the sealer and the stopper) may be removably disposed in the production tubing or the casing. For example, the nozzle assembly may be positioned in the production tubing or the casing at a desired location by engaging the tool engagement segment (e.g., proximate to the diffuser of the nozzle of the nozzle assembly) with the wireline tool by frictional fit or mechanical connection. As discussed hereinabove, the wireline tool engages the fishneck and the lip of the tool engagement segment in order to interact with the nozzle of the nozzle assembly.

Similarly, the nozzle assembly may be disposed in a particular position in the casing of the well, and the well does not include any production tubing. The nozzle assembly may be disposed in a particular position in the casing of the well that does not include the production tubing, but the well does include production tubing in other portions of the well. The nozzle assembly may be disposed in a position in the production tubing, and the production tubing is within the casing. For example, the nozzle assembly may be disposed in the production tubing before or after the production tubing is inserted into the well. As another example, with the production tubing in place in the well, the nozzle assembly may be lowered into the production tubing using the wireline tool until the nozzle assembly is at a desired location. The wellhead equipment may be kept in place when the wireline tool is used, but the wellhead equipment may have to be uninstalled in some instances when the wireline tool is not used. Nonetheless, after the wireline tool has been used to dispose the nozzle assembly in its desired position, the wireline tool may be disengaged from the tool engagement segment and removed, leaving the nozzle assembly in place. The nozzle assembly may stay in place via the seal created by the sealer of the nozzle assembly against the inner surface of the production tubing or the casing. The nozzle assembly may stay in place via the stopper of the nozzle assembly. The nozzle assembly may stay in place via both the sealer and the stopper of the nozzle assembly.

Similarly, in some embodiments, the nozzle of the nozzle assembly may include connection members on the outer surface of the nozzle to facilitate the engagement of the nozzle with the inner surface of the production tubing or the casing as described hereinabove. The connection members may be engaged or disengaged from the inner surface of the production tubing or the casing by pulling with slick line or jar down to lock the nozzle of the nozzle assembly.

Similarly, in some instances, it may also be desirable to move or remove the nozzle assembly from the production tubing or the casing. For example, after production of the well, the conditions of the well may change, the understanding of the well conditions may improve, and/or an element of the nozzle assembly or other may be damaged or worn. In such cases, the wireline tool may be inserted into the production tubing or the casing to engage the tool engagement segment (e.g., proximate to the diffuser of the nozzle of the nozzle assembly) so that the wireline tool may be used to either move the nozzle assembly to a different location in the production tubing or the casing, or alternatively, to remove the nozzle assembly from the production tubing or the casing. Alternatively, if the nozzle assembly is installed in the wall such that the stopper or the sealer of the nozzle assembly is closest to the surface location, then a tool, such as a wireline tool, may engage the stopper or the sealer of the nozzle assembly to install, move, and/or remove the nozzle assembly in the well (e.g., FIG. 4A).

It is also worth noting that although the entire nozzle assembly may be installed and/or removed from the production tubing or the casing, in some embodiments, one or more elements of the nozzle assembly may be installed and/or removed one element at a time. For example, in some embodiments, first the stopper may be disposed in the production tubing using a tool, then the sealer may be disposed in the production tubing and coupled to the stopper (e.g., by threaded engagement) using a tool, and then the nozzle may be disposed in the production tubing and coupled to the sealer (e.g., by threaded engagement) via a tool engagement segment proximate to the intake using a tool. Alternatively, in some embodiments, first the nozzle may be disposed in the production tubing using a tool, and then the stopper may be disposed in the production tubing and coupled to the nozzle (e.g., by threaded engagement) via a tool engagement segment proximate to the diffuser using a tool, and so on.

Those of ordinary skill in the art will appreciate that various modifications may be made. Some embodiments may include a plurality of nozzles, a plurality of sealers, a plurality of stoppers, a plurality of nozzle assemblies, or any combination thereof. In some embodiments, it is appreciated that some wells may benefit from the use of a plurality of nozzles alone in the production tubing or the casing to improve deliquification. For example, a nozzle alone (as discussed herein with the intake, the throat, and the diffuser) is disposed at a location along the length of the production tubing and at least one other nozzle alone (as discussed herein with the intake, the throat, and the diffuser) is disposed at a different location along the length of the production tubing. In some embodiments, it is appreciated that some wells may benefit from the use of a plurality of nozzle assemblies in the production tubing or the casing to improve deliquification. For example, a nozzle assembly having a nozzle, a sealer, and a stopper is disposed at a location along the length of the production tubing and at least one other nozzle assembly having a nozzle, a sealer, and a stopper is disposed at a different location along the length of the production tubing. In another embodiment, a nozzle assembly having a nozzle, a sealer, and a stopper is disposed at a location along the length of the production tubing and at least one other nozzle assembly having a nozzle and a sealer is disposed at a different location along the length of the production tubing. In another embodiment, a nozzle assembly having a nozzle, a sealer, and a stopper is disposed at a location along the length of the production tubing and at least one other nozzle assembly having a nozzle and a stopper is disposed at a different location along the length of the production tubing. In another embodiment, a nozzle assembly having a nozzle and another element (e.g., a sealer or a stopper) is disposed at a location along the length of the production tubing and at least one other nozzle assembly having a nozzle and another element (e.g., a sealer or a stopper) is disposed at a different location along the length of the production tubing. Moreover, in some embodiments, a nozzle assembly is disposed at a location along the length of the production tubing and at least one nozzle alone (as discussed herein with the intake, the throat, and the diffuser) is disposed at a different location along the length of the production tubing. Similar embodiments may be provided in the context of the casing.

As an example, one embodiment may include three nozzles (as discussed herein with the intake, the throat, and the diffuser) disposed at spaced locations along the length of the production tubing. The produced fluid passing through the production tubing passes successively through each of the three nozzles. Each nozzle is generally configured as described above and adapted to deliquefy the produced fluid. For example, as the produced fluid flows through the production tubing (i.e., before entering the first nozzle, between the successive nozzles, and after exiting the last nozzle), the produced fluid may tend to liquefy. The nozzle may be positioned at successive lengths so that the produced fluid encounters the nozzle after some liquefaction has occurred. Thus, the deliquefying effect provided by the nozzle may be repeated along the production tubing, thereby further facilitating the transmission of the produced fluid therethrough.

As an example, one embodiment may include three nozzle assemblies disposed at spaced locations along the length of the production tubing. The produced fluid passing through the production tubing passes successively through each of the three nozzle assemblies. Each nozzle assembly is generally configured as described above and adapted to deliquefy the produced fluid. For example, as the produced fluid flows through the production tubing (i.e., before entering the first nozzle assembly, between the successive nozzles, and after exiting the last nozzle assembly), the produced fluid may tend to liquefy. The nozzle assemblies may be positioned at successive lengths so that the produced fluid encounters the nozzle assemblies after some liquefaction has occurred. Thus, the deliquefying effect provided by the nozzle assemblies may be repeated along the production tubing, thereby further facilitating the transmission of the produced fluid therethrough.

Construction:

The nozzle or the nozzle assembly will be installed downhole in the production tubing or the casing of the well. Thus, the nozzle or the nozzle assembly should be capable of withstanding the downhole temperature (or range of downhole temperatures) and the downhole pressure (or range of downhole pressures) to be encountered in the well. In some embodiments, the nozzle is able to withstand a temperature range of −50° F. to 400° F. In some embodiments, the nozzle is able to withstand a temperature range of −50° F. to 350° F. In some embodiments, the nozzle is able to withstand a temperature range of −50° F. to 300° F. In some embodiments, the nozzle is able to withstand a temperature range of −50° F. to 200° F. In some embodiments, the nozzle is able to withstand a temperature range of −50° F. to 100° F. In some embodiments, the nozzle is able to withstand a temperature range of −50° F. to 50° F. In some embodiments, the nozzle is able to withstand a temperature range of 50° F. to 200° F. In some embodiments, the nozzle is able to withstand a temperature range of 75° F. to 300° F. In some embodiments, the nozzle is able to withstand a pressure range of 0 psig to 20,000 psig. In some embodiments, the nozzle is able to withstand a pressure range of 0 psig to 15,000 psig. In some embodiments, the nozzle is able to withstand a pressure range of 0 psig to 10,000 psig. In some embodiments, the nozzle is able to withstand a pressure range of 0 psig to 5,000 psig. In some embodiments, the nozzle is able to withstand a pressure range of 2,000 psig to 12,000 psig. In some embodiments, the nozzle is able to withstand a pressure range of 250 psig to 5,000 psig. In some embodiments, the nozzle is able to withstand a pressure range of 500 psig to 2,000 psig. The nozzle may be formed as one piece or as a plurality of pieces that are coupled together (e.g., by welding, threading, etc.). The nozzle may be formed of the following materials: ceramic, stainless steel, carbon steel with a special coating, low alloy steel, martensitic steel, Ni-resist alloys (Type 1 and Type 2), inconel, chromium, or any combination thereof.

The sealer, the stopper, or both may have similar temperature tolerances as the nozzle. For example, the sealer, the stopper, or both may be able to withstand a temperature range of −50° F. to 400° F. The sealer, the stopper, or both may have similar pressure tolerances as the nozzle. For example, the sealer, the stopper, or both may be able to withstand a pressure range of 0 psig to 5,000 psig. Furthermore, the sealer, the stopper, or both may be formed of a material similar to the nozzle. For example, the sealer, the stopper, or both may be formed of the following materials: ceramic, stainless steel, carbon steel with a special coating, low alloy steel, martensitic steel, Ni-resist alloys (Type 1 and Type 2), inconel, chromium, or any combination thereof.

Controller Assembly:

In some embodiments, the well may include a controller assembly, or both a controller assembly and a foaming assembly. The controller assembly may be coupled to the well to adjust the pressure in the well (e.g., increase pressure), adjust flow rate of the produced fluid in the well (e.g., increase flow rate of the produced fluid), etc. The controller assembly includes a controller coupled to a motor valve via a connection. For example, the controller is configured to automatically open and/or close the motor valve, which in turn opens and/or closes the well, to build up pressure in the well. Commercially available examples of the controller include the SMI Differential Pressure Controller by IPS, CEO III by Weatherford, LiquiLift Controller by PCS Ferguson, etc. Commercially available examples of the motor valve include the Kimray 2" Electropneumatic Valve Positioner, EDI-MV Motor Valve Electronic Design for Industry, MPC-F Motor Valve by Multi Products Company, etc.

The controller assembly may optionally include at least one tubing sensor coupled to or part of the production tubing that is connected to the controller via a corresponding connection for monitoring pressure of the production tubing. Commercially available examples of the production tubing sensor include 2-Wire and 3-Wire sensors by IPS, etc. The controller assembly may optionally include at least one casing sensor coupled to or part of the casing that is connected to the controller via a corresponding connection for monitoring pressure of the casing. Commercially available examples of the casing sensor include 2-Wire and 3-Wire sensors by IPS, etc. The controller assembly may also include other components in some embodiments. For example, in some embodiments, the controller assembly may even include a connection to at least one component of other artificial lift systems used in the well, such as a connection to a plunger detector when plunger lift is used.

The controller receives data from the at least one tubing sensor, the at least one casing sensor, or both. The controller adjusts the motor valve in response to the data received from the sensor(s) to adjust the pressure in the well, to adjust the flow rate of the produced fluid in the well, etc. For example, when the production tubing sensor provides data indicative of a production tubing pressure in a range of 20 psig to 1,000 psig, then the controller may close the motor valve and shut down the well. For example, when the production tubing sensor provides data indicative of a production tubing pressure in a range of 20 psig to 2,000 psig, then the controller may open the motor valve and reopen the well. For example, when the casing sensor provides data indicative of a casing pressure in a range of 20 psig to 1,000 psig, then the controller may close the motor valve and shut down the well. For example, when the casing sensor provides data indicative of a casing pressure in a range of 40 psig to 2,000 psig, then the controller may open the motor valve and reopen the well. In some embodiments, when the production tubing sensor provides indicative of a production tubing pressure in a range of 20 psig to 1,000 psig and the casing sensor provides indicative of a casing pressure in a range of 20 psig to 1,000 psig, then the controller may close the motor valve and shut down the well. In some embodiments, when the tubing sensor provides indicative of a production tubing pressure in a range of 50 psig to 1,000 psig and the casing sensor provides indicative of a casing pressure in a range of 100 psig to 2,000 psig, then the controller may open the motor valve and reopen the well. Those of ordinary skill in the art will appreciate that these pressure values may vary (e.g., the pressure values may be much higher in some embodiments) and should not limit the scope of the disclosure. For example, in some embodiments, the pressure readings may be dependent on the well type and depth of the well.

Alternatively, in some embodiments, the controller may open and/or close the motor valve based on a timer. The timer may be a component of the controller or time data may be received by the controller from a timer that is external to the controller. In some embodiments, the controller may rely on data received from the sensor(s) and the timer to open and/or close the motor valve.

Foamer Assembly:

In some embodiments, the well may include a foaming assembly, or both a foaming assembly and a controller assembly. The foaming assembly may be coupled to the well for the purpose of injecting a foaming agent (e.g., surfactant) into the well with the intention of creating foam and the objective of reducing the critical gas rate. In some embodiments, the foaming assembly includes (a) at least one tank to store at least one foaming agent (e.g., a chemical foaming agent) to be injected into the well, (b) at least one pump (e.g., coupled to the tank), (c) optionally at least one capillary tubing coupled to the pump and the tank, and (d) optionally at least one capillary tubing valve coupled to the capillary tubing to open and/or close the corresponding capillary tubing. In some embodiments, other tubing arrangements may also be used instead of capillary tubing. The foaming assembly may also include other components in some embodiments.

In some embodiments, the foaming agent is introduced into the production tubing or the casing through the capillary tubing and the capillary tubing valve disposed in the producing tubing or the casing. The capillary tubing valve is in fluid communication with the capillary tubing and prevents backflow inside the capillary tubing, and allows for controlled injection volumes to be applied to the production tubing or the casing. For example, the capillary tubing valve may be a spring-loaded differential valve in some embodiments. The capillary tubing may receive the foaming agent from the equipment at a surface location injection (e.g., a continuous application via the production tubing or the casing). The surface equipment can include, for example, (b) a chemical supply tank, (b) chemical pump (e.g., such as Texsteam SolarLite Solar Chemical Injection Pump by GE Oil & Gas, etc.), other conventional chemical injection equipment (e.g., valves, controllers, gauges), or any combination thereof.

The foaming agent (also referred to in the petroleum industry as "foamers") reduces the surface tension and fluid density of fluids, thereby reducing the hydrostatic pressure in the production tubing or the casing and allowing for unloading and improved production rates of fluids from the producing zone(s) of the reservoir. Examples of foaming agents include, but are not limited to, surfactants such as betaines, amine oxides, sulfonates (e.g., alpha-olefin sulfonates), sulfates (e.g., lauryl sulfates), anionic, nonionic, cationic, amphoteric, or any combination thereof. Furthermore, the surfactant may be an organic surfactant, a synthetic surfactant (e.g., that includes a polymer), or any combination thereof. Commercially available examples of the foaming agents that may be used include F.O.A.M FMW25 by Baker Hughes, F.O.A.M FMW3059 by Baker Hughes, F.O.A.M FMW6000 by Baker Hughes, etc.

In some embodiments, the foaming agent may be delivered downstream of the nozzle or the nozzle assembly, upstream of the nozzle or the nozzle assembly, or any combination thereof. In some embodiments, the foaming agent may be delivered upstream of the nozzle or the nozzle assembly using at least one capillary tubing and corresponding capillary tubing valve in the production tubing or the casing. For example, the capillary tubing in the production tubing or the casing delivers the foaming agent through the capillary tubing valve into an area outside and upstream of the diffuser of the nozzle. In some embodiments, the foaming agent may be delivered downstream of the nozzle or the nozzle assembly using at least one capillary tubing and corresponding capillary tubing valve in the annulus between the production tubing and the casing. In this example, the capillary tubing in the annulus may be attached to the outer surface of the production tubing. As another example, the foaming agent may be delivered downstream of the nozzle or the nozzle assembly by injecting the foaming agent in the annulus (e.g., batch treatment with no capillary tubing) between the production tubing and the casing. Furthermore, in some embodiments, the capillary tubing in the production tubing or the casing delivers the foaming agent into a passageway of the intake, the throat, or the diffuser of the nozzle. Thus, the foaming agent can be delivered upstream of the nozzle or the nozzle assembly, downstream of the nozzle or nozzle assembly, directly into the passageway of the nozzle, or any combination thereof.

In some embodiments, a plurality of nozzles (alone or as part of nozzle assemblies) may be disposed at spaced locations along a length of the production tubing or the casing such that the produced fluid passes successively through each of the nozzles. Here, the foaming agent may be delivered proximate to one or more of the plurality of the nozzles via at least one capillary tubing in the production tubing or the casing, via at least one capillary tubing in the annulus, via batch treatment (no capillary tubing) in the annulus, or any combination thereof. For example, a single capillary tubing may supply multiple capillary tubing valves. As another example, one skilled in the art will appreciate that each capillary tubing valve may alternatively be supplied through a separate capillary tubing.

In short, at least one capillary tubing may deliver foaming agent into the production tubing or the casing proximate to at least one nozzle or nozzle assembly such that mixing of the foaming agent may be increased within the production tubing or the casing due to agitation of the produced fluid passing through the at least one nozzle. For example, the at least one nozzle may create better foaming action of the injected foaming agent than the foaming action of the foaming agent without the at least one nozzle (e.g., merely injecting the foaming agent alone). Furthermore, those of ordinary skill in the art will appreciate that various modifications may be made to the foaming assembly. Moreover, in some embodiments, at least one soap stick may be added to the well in addition to the foaming agent, or instead of the foaming agent.

Various Embodiments

Referring to FIG. 1A, FIG. 1A illustrates one embodiment of a system 100 for deliquefying a produced fluid 101 that is produced from a well 105, such as a gas well, from a reservoir 110, such as a subsurface gas reservoir, to a surface location 115. The reservoir 110 can be any type of subsurface formation in which hydrocarbons are stored, such as limestone, dolomite, oil shale, sandstone, or any combination thereof. Furthermore, the reservoir 110 may include a plurality of zones (e.g., a plurality of producing zones) and the produced fluid 101 may come from any or all of the zones of the plurality of zones. Alternatively, the reservoir 110 may not include a plurality of zones (e.g., in which case the reservoir 110 may simply be a producing zone) and the produced fluid 101 may simply come from the reservoir 110. The produced fluid 101 may include practically any fluid that may come from the reservoir 110, including hydrocarbons in any phase such as a gas phase, a liquid phase, or any combination thereof.

The well 105 generally includes a casing 120 that extends from the surface location 115 downward from the ground surface 125 at least to the depth of the reservoir 110. The casing 120 may include one or more radially concentric layers, though a single layer is shown in FIG. 1A for illustrative clarity. Also, while the casing 120 is arranged in a linear and vertical configuration in FIG. 1A, it is appreciated that the well 105 can be otherwise configured, for example, extending at an angle or defining curves or angles so that different portions of the well 105 extend along different directions. For example, in some cases, the well 105 can include portions that are generally vertical in configuration and/or portions that are generally horizontal in configuration (e.g., the system 700 of FIG. 7). Furthermore, the well 105 can be completed in any manner (e.g., a barefoot completion, an openhole completion, a liner completion, a perforated casing, a cased hole completion, a conventional completion, etc.).

A production tubing 130, which is typically made up of steel pipe segments coupled end-to-end, is disposed in the casing 120. The production tubing 130 extends from the reservoir 110 to the surface location 115 (i.e., ground surface or platform surface in the event of an offshore production well). The production tubing 130 is configured to receive the produced fluid 101 from the reservoir 110 and transmit the produced fluid 101 to the surface location 115. Some embodiments may not include the production tubing 130, and may simply include the casing 120.

A Christmas tree or other wellhead equipment can be connected to the production tubing 130 at the surface location 115 and configured to receive the produced fluid 101 for processing, storage, and/or further transport. For example, the wellhead equipment can be connected to a flowline 135 that delivers the produced fluid 101 from the well 105 to a processing or storage facility.

As illustrated in FIG. 1A, the wellhead equipment may include a controller assembly 140 coupled to the well 105. The controller assembly 140 includes a controller 145 coupled to a motor valve 150 via connection 151. The controller 145 is configured to automatically open and/or close the motor valve 150 without human intervention, which in turn automatically opens and/or closes the well 105, to build up pressure in the well 105 in some embodiments. The controller assembly 140 may optionally include at least one production tubing sensor 155 coupled to or part of the production tubing 130 that is connected to the controller 145 via a corresponding connection 156 for monitoring pressure of the production tubing 130. The controller assembly 140 may optionally include at least one casing sensor 160 coupled to or part of the casing 120 that is connected to the controller 145 via a corresponding connection 161 for monitoring pressure of the casing 120.

As illustrated in FIG. 1A, the well 105 uses plunger lift as the artificial lift system, and therefore, the wellhead equipment of the well 105 may also include a plunger detector that may or may not be connected to the controller 145 via a corresponding connection, a plunger catcher, a lubricator, a shock spring, one or more other plunger lift components, one or more gauges, one or more connectors, one or more other sensors, etc. Of course, those of ordinary skill in the art will appreciate that the exact components of the wellhead equipment may depend on the artificial lift system used or other desired characteristics.

In some embodiments, the production tubing 130 can be sealed from the casing 120 by one or more packers (not shown). Each packer extends circumferentially around the production tubing 130 and radially between the outer surface of the production tubing 130 and an inner surface of the innermost casing 120. In this way, the produced fluid 101 can be prevented from flowing through the annulus between the production tubing 130 and the casing 120. Instead, the produced fluid 101 flows through the production tubing 130, as controlled by the wellhead equipment. Perforations 165 in the casing 120 allow the fluids from the reservoir 110 to flow into the casing 120 and then production tubing 130, and, if the pressure in the reservoir 110 is sufficient, the reservoir pressure can cause the fluid to be produced through the well 105 to the wellhead equipment at the surface location 115.

As illustrated in FIG. 1A, a nozzle assembly 170 is also disposed in the production tubing 130. The nozzle assembly 170 includes at least three elements, namely, a nozzle 175 with tool engagement segments 176, 177, a sealer 180 coupled to the nozzle 175 via the tool engagement segment 176, and a stopper 185 coupled to the sealer 180. The sealer 180 may be a staging tool and the stopper 185 may be a locking tool. The nozzle 175 and the tool engagement segments 176, 177 are illustrated in cross section to show the coupling of the nozzle 175 via the tool engagement segment 176 with the sealer 180. The tool engagement segment 177 has a fishneck 178 with a lip 179. Some embodiments may not include the sealer 180, and the nozzle 175 may be coupled to the stopper 185.

The nozzle 175 defines a flow path for the produced fluid 101 along the length of the nozzle 175 (along line A). The nozzle 175 is generally configured to receive the produced fluid 101 through an intake 186 that defines a nozzle inlet, deliver the produced fluid 101 to a throat 187, and then deliver the produced fluid 101 to a diffuser 188 that defines a nozzle outlet. For example, the diffuser 188 is distal to the intake 186. The tool engagement segment 176 that is proximate to the intake 186 may include threads for coupling the nozzle 175 to the sealer 180, as shown.

Figure 1B:
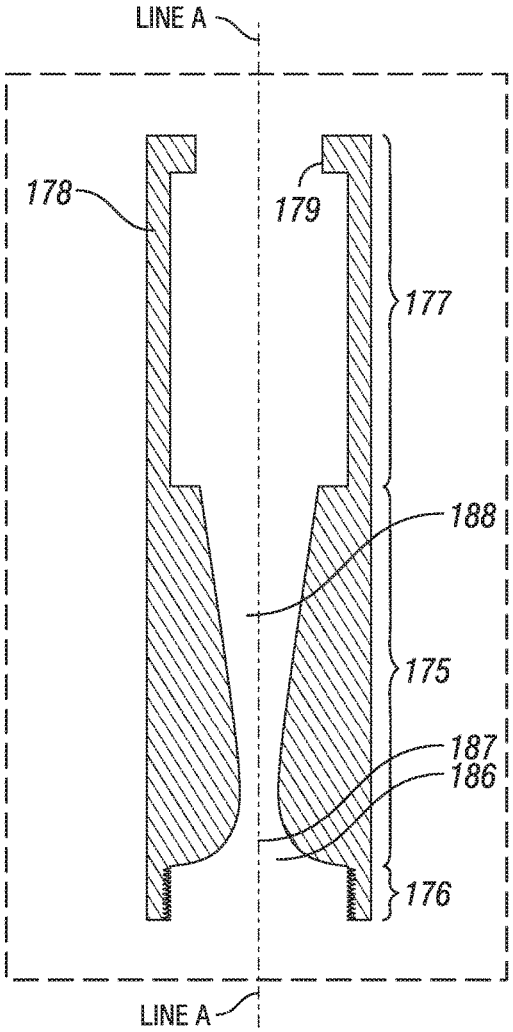
FIG. 1B is an expanded view of the deliquification assembly shown in box 1B in FIG. 1A.

As illustrated in FIGS. 1A and 1B, the nozzle 175 has a non-uniform internal cross-sectional area. For example, as the produced fluid 101 flows through the nozzle 175, the produced fluid 101 encounters a cross-sectional area that decreases in the intake 186 towards the narrowest cross-sectional area at the throat 187 and then increases in the diffuser 188. The throat 187 defines a region of decreased cross-sectional area that agitates (e.g., alters velocity of the flow, alters the pressure, deliquefies) the produced fluid 101 passing through the nozzle 175.

In operation, the produced fluid 101 enters the production tubing 130 from the reservoir 110 (e.g., via the perforations 165) and the produced fluid 101 flows up through the stopper 185, then up through the sealer 180, and then up through the nozzle 175. The sealer 180 creates a seal with the production tubing 130 and ensures that the produced fluid 101 flows through the nozzle 175 and not around the nozzle 175. The stopper 185 is used to keep the sealer 180 and the nozzle 175 in place. The produced fluid 101 is deliquefied as it flows through the nozzle 175. Based on the pressure data (e.g., pressure values) received from the production tubing pressure sensor 155, the casing pressure sensor 160, the timer (e.g., of the controller 145), or any combination thereof, the controller 145 may close and/or open the motor valve 150 to assist with deliquification of the produced fluid 101.

Figure 2:
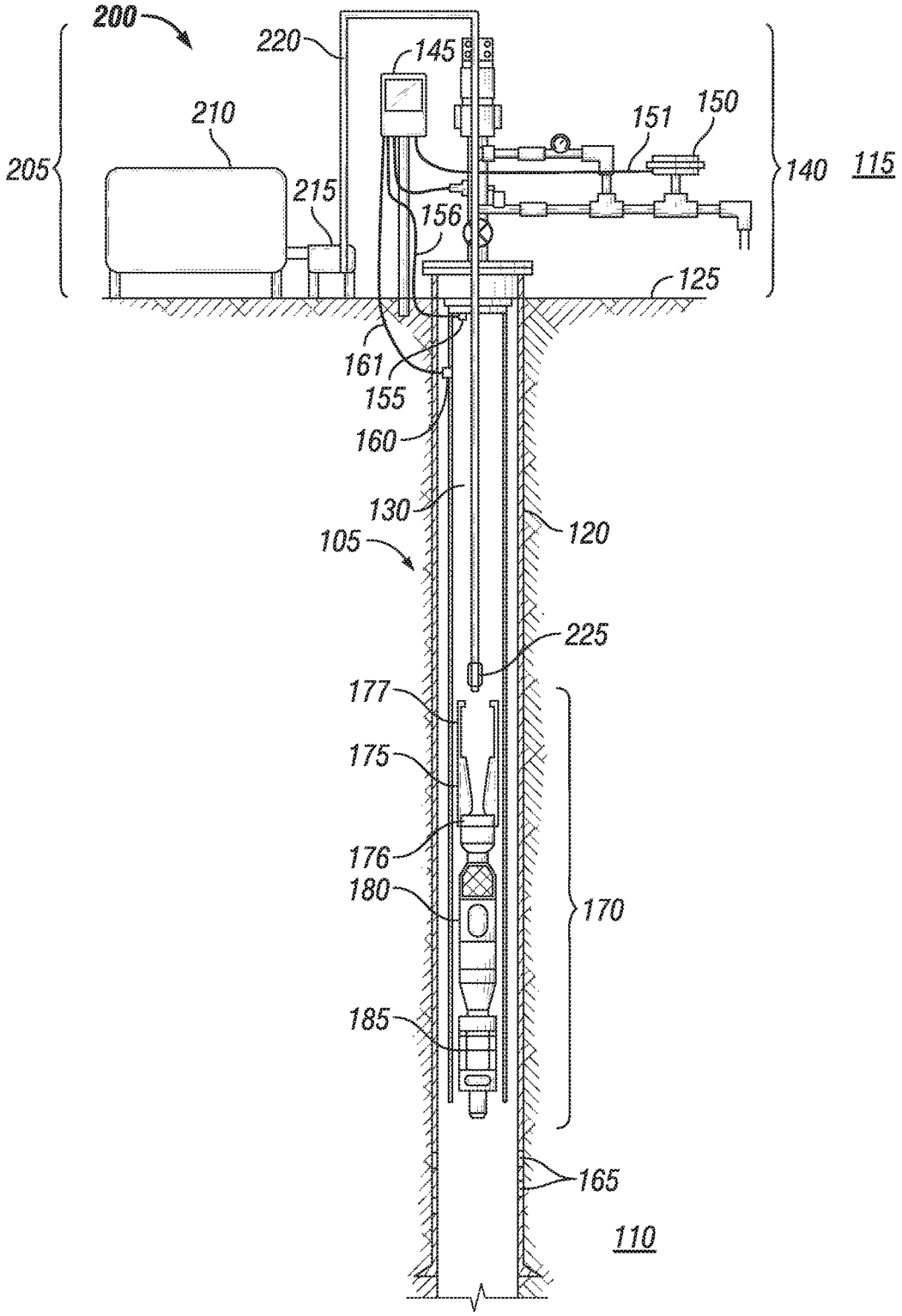
FIG. 2 illustrates one embodiment of a system for deliquefying produced fluid being produced from a well. The system of FIG. 2 is similar to the system of FIG. 1A, but FIG. 2 includes a foaming assembly in addition to the controller assembly and the nozzle assembly with three elements.

Referring to FIG. 2, FIG. 2 illustrates one embodiment of a system 200 for deliquefying the produced fluid 101. The system 200 is similar to the system 100 of FIG. 1A, but FIG. 2 includes a foaming assembly 205 in addition to the controller assembly 140 and the nozzle assembly 170 with three elements. The foaming system 205 includes at least one tank 210 for storing a foaming agent and at least one pump 215 for pumping the foaming agent out of the tank 210 for injection into the well 105. The foaming system 205 may also include at least one capillary tubing 220 with at least one capillary tubing valve 225. The capillary tubing 220 and the corresponding capillary tubing valve 225 is inserted into the production tubing 130 (or the casing 120 if no production tubing 130 were present in an embodiment). As illustrated in FIG. 2, the capillary tubing 220 and the corresponding capillary tubing valve 225 is disposed upstream of the nozzle 175. For example, the foaming assembly 205 may deliver the foaming agent into the production tubing 130 according to a schedule, based on some ratio of production tubing/casing pressure, based on the production tubing or casing pressure rising or falling below a certain value, based on operator intervention, or any combination thereof. The controller assembly 140 and the foaming assembly 205 work together for deliquification of the produced fluid 101.

Figure 3:
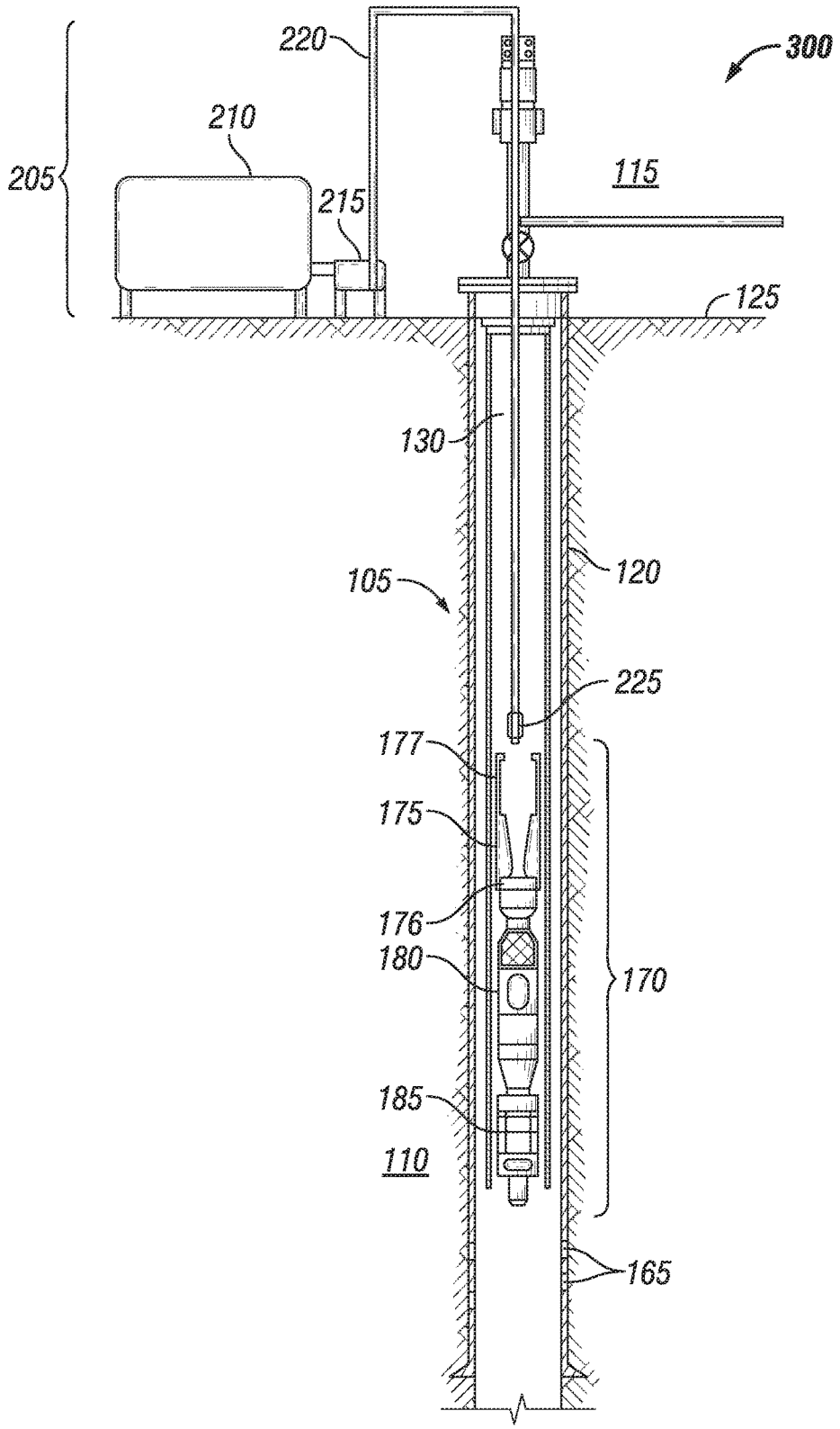
FIG. 3 illustrates one embodiment of a system for deliquefying produced fluid being produced from a well. The system of FIG. 3 is similar to the system of FIG. 2, but FIG. 3 does not include the controller assembly.

Referring to FIG. 3, FIG. 3 illustrates one embodiment of a system 300 for deliquefying the produced fluid 101. The system 300 is similar to the system 200 of FIG. 2, but FIG. 3 does not include the controller assembly 140.

Figure 4A:
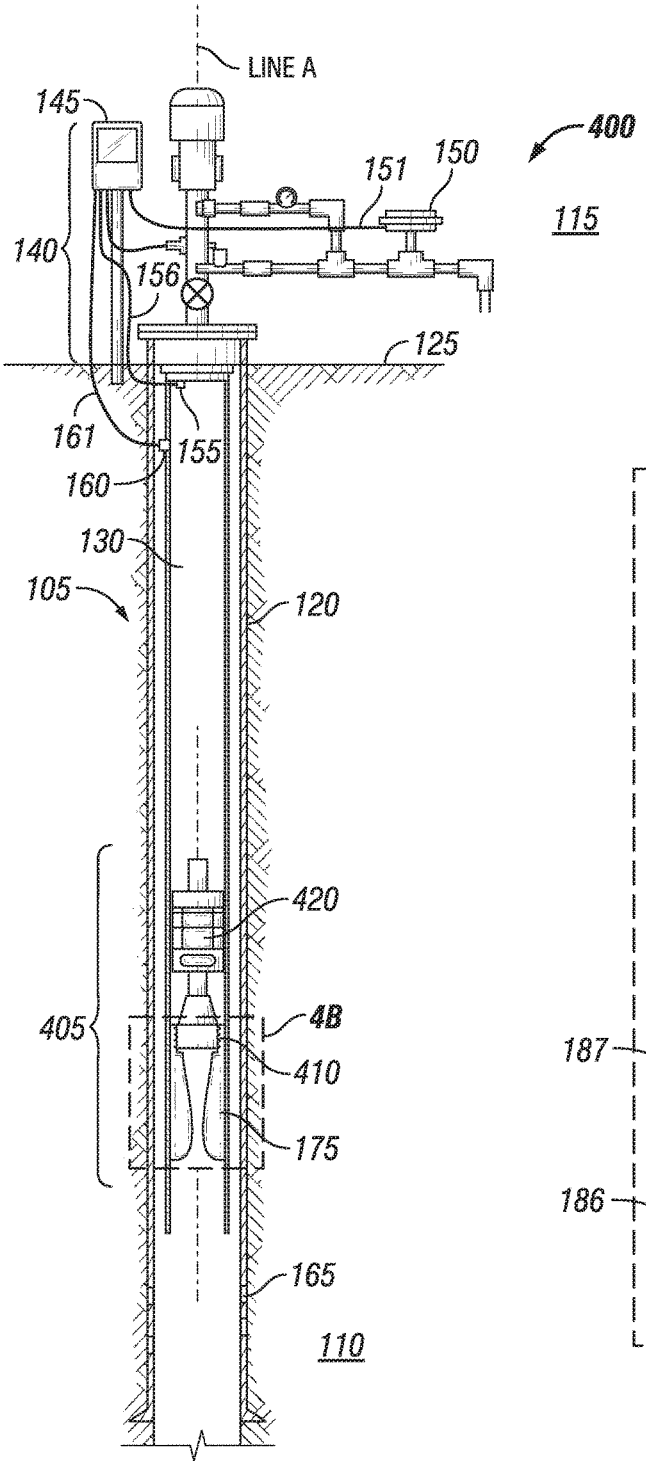
FIG. 4A illustrates one embodiment of a system for deliquefying produced fluid being produced from a well. The system of FIG. 4A is similar to the system of FIG. 1A, but FIG. 4A includes a nozzle assembly with two elements instead of the nozzle assembly with three elements in addition to the controller assembly. The two elements are also provided in a different order.
Figure 4B:
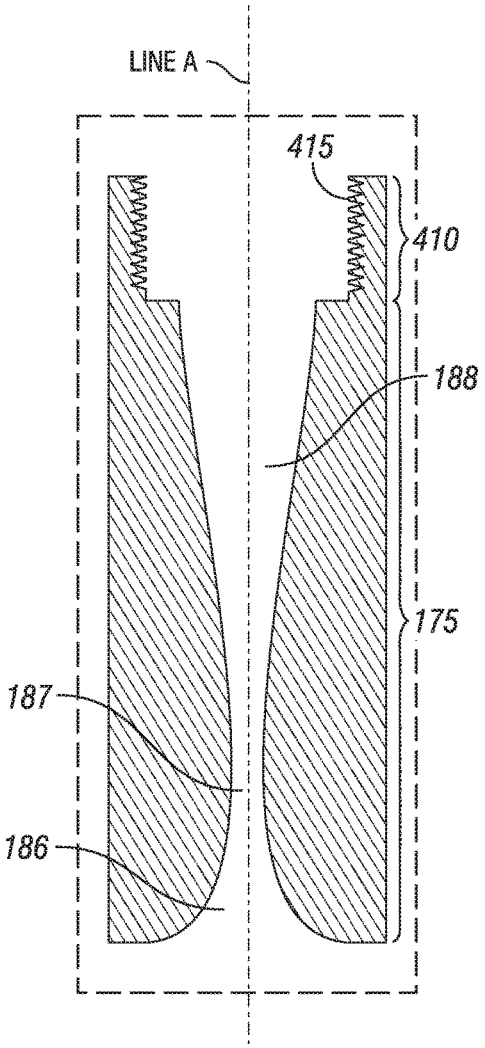
FIG. 4B is an expanded view of the deliquification assembly shown in box 4B of FIG. 4A.

Referring to FIG. 4A, FIG. 4A illustrates one embodiment of a system 400 for deliquefying the produced fluid 101. The system 400 is similar to the system 100 of FIG. 1A, but FIG. 4A includes a nozzle assembly 405 with two elements instead of the nozzle assembly 170 with three elements in addition to the controller assembly 140, and the two elements are provided in a different order. The nozzle assembly 405 includes the nozzle 175 with a tool engagement segment 410 with threads 415 proximate to the diffuser 188, shown in more detail in FIG. 4B. The tool engagement segment 410 is used to couple the nozzle 175 to a stopper 420. The stopper 420 is similar to the stopper 185 except that the stopper 420 is installed in an inverted manner to facilitate the coupling. Furthermore, the order of the nozzle assembly 405 has swapped as compared to the nozzle assembly 170, such that the stopper 420 is closer to the surface location 115 in FIG. 4A instead of farthest away in FIG. 1A.

In operation, the produced fluid 101 enters the production tubing 130 from the reservoir 110 (e.g., via the perforations 165) and the produced fluid 101 flows up through the nozzle 175, and then up through the stopper 420. The stopper 420 is used to keep the nozzle 175 in place. The produced fluid 101 is deliquefied as it flows through the nozzle 175. Based on the data received from the production tubing pressure sensor 155, the casing pressure sensor 160, the timer (e.g., of the controller 145), or any combination thereof, the controller 145 may close and/or open the motor valve 150 to assist with deliquification of the produced fluid 101.

Figure 5:
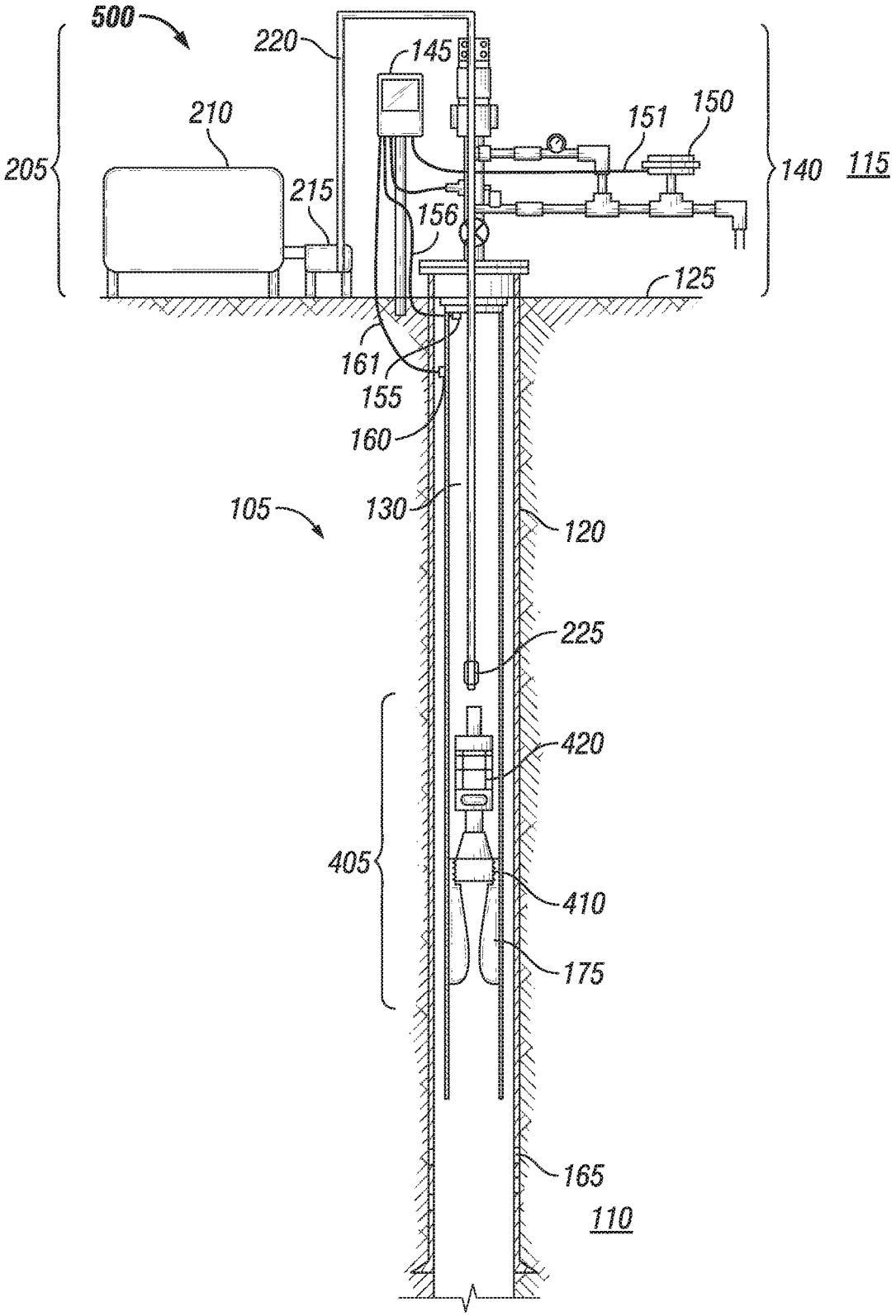
FIG. 5 illustrates one embodiment of a system for deliquefying produced fluid being produced from a well. The system of FIG. 5 is similar to the system of FIG. 4A, but FIG. 5 includes the foaming assembly in addition to the nozzle assembly with two elements and the controller assembly.

Referring to FIG. 5, FIG. 5 illustrates one embodiment of a system 500 for deliquefying the produced fluid 101. The system 500 is similar to the system 400 of FIG. 4A, but FIG. 5 includes the foaming assembly 205 in addition to the nozzle assembly 405 with two elements and the controller assembly 140.

Figure 6:
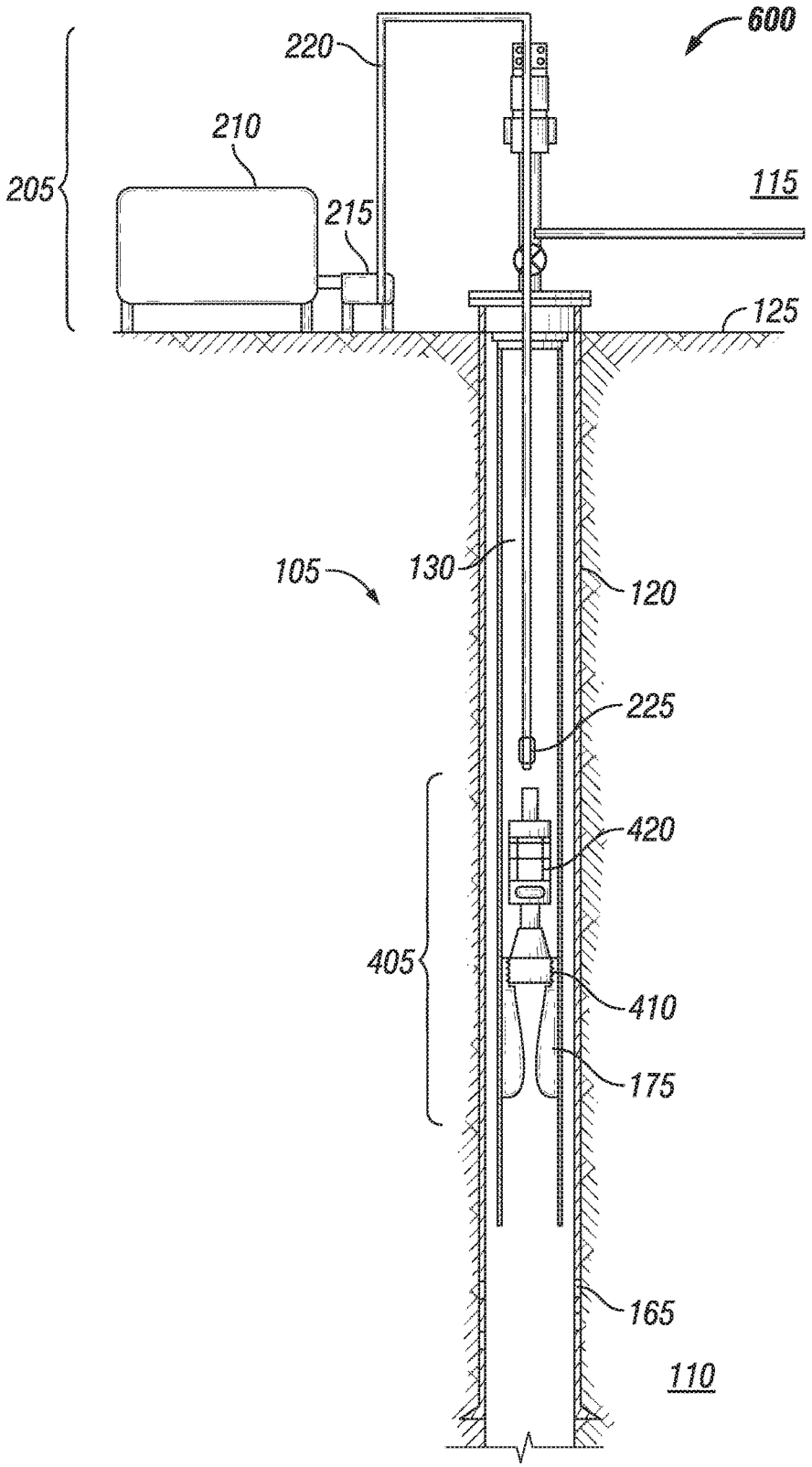
FIG. 6 illustrates one embodiment of a system for deliquefying produced fluid being produced from a well. The system of FIG. 6 is similar to the system of FIG. 5, but FIG. 6 does not include the controller assembly.

Referring to FIG. 6, FIG. 6 illustrates one embodiment of a system 600 for deliquefying the produced fluid 101. The system 600 is similar to the system 500 of FIG. 5, but FIG. 6 does not include the controller assembly 140.

Figure 7:
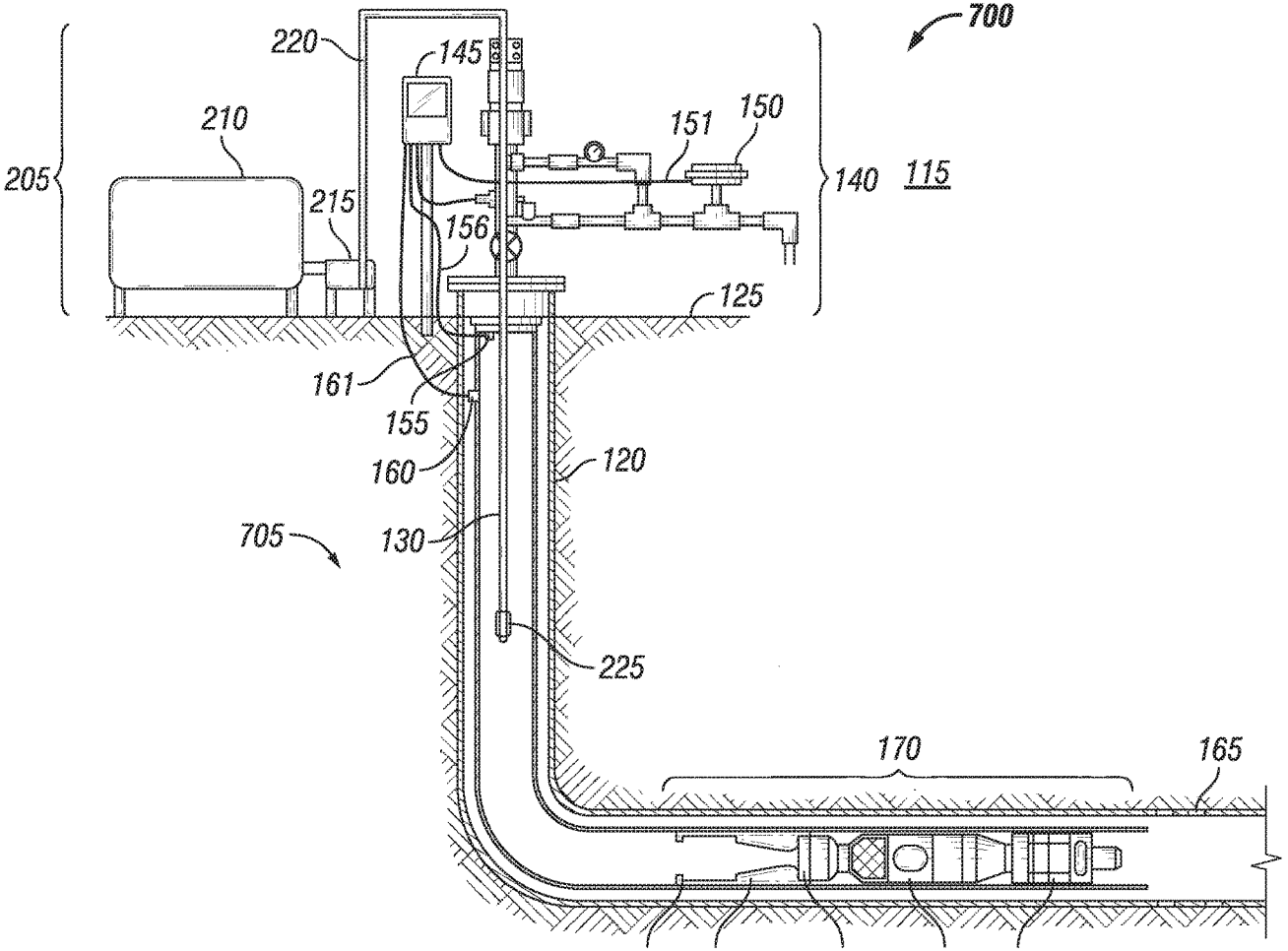
FIG. 7 illustrates one embodiment of a system for deliquefying produced fluid being produced from a well. The system of FIG. 7 is similar to the system of FIG. 2, but FIG. 7 illustrates the controller assembly, foaming assembly, and the nozzle assembly with three elements in the context of a horizontal well.

Referring to FIG. 7, FIG. 7 illustrates one embodiment of a system 700 for deliquefying the produced fluid 101. The system 700 is similar to the system 200 of FIG. 2, but FIG. 7 illustrates the controller assembly 140 and the nozzle assembly 170 with three elements in the context of a horizontal well 705.

Figure 8:
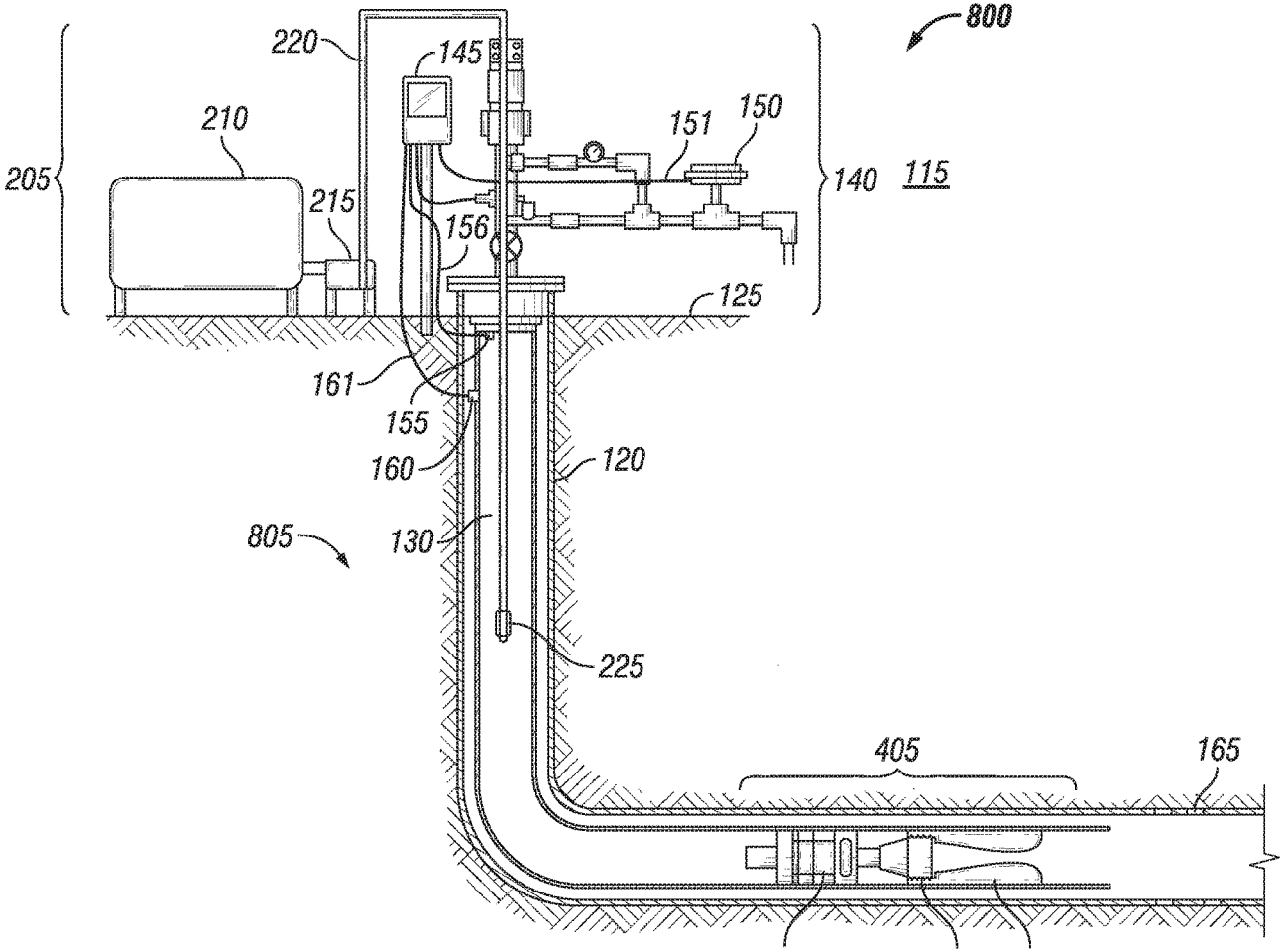
FIG. 8 illustrates one embodiment of a system for deliquefying produced fluid being produced from a well. The system of FIG. 8 is similar to the system of FIG. 5, but FIG. 8 illustrates the controller assembly, foaming assembly, and the nozzle assembly with two elements in the context of a horizontal well.

Referring to FIG. 8, FIG. 8 illustrates one embodiment of a system 800 for deliquefying the produced fluid 101. The system 800 is similar to the system 500 of FIG. 5, but FIG. 8 illustrates the controller assembly 140 and the nozzle assembly 405 with two elements in the context of a horizontal well 805.

Figure 9:
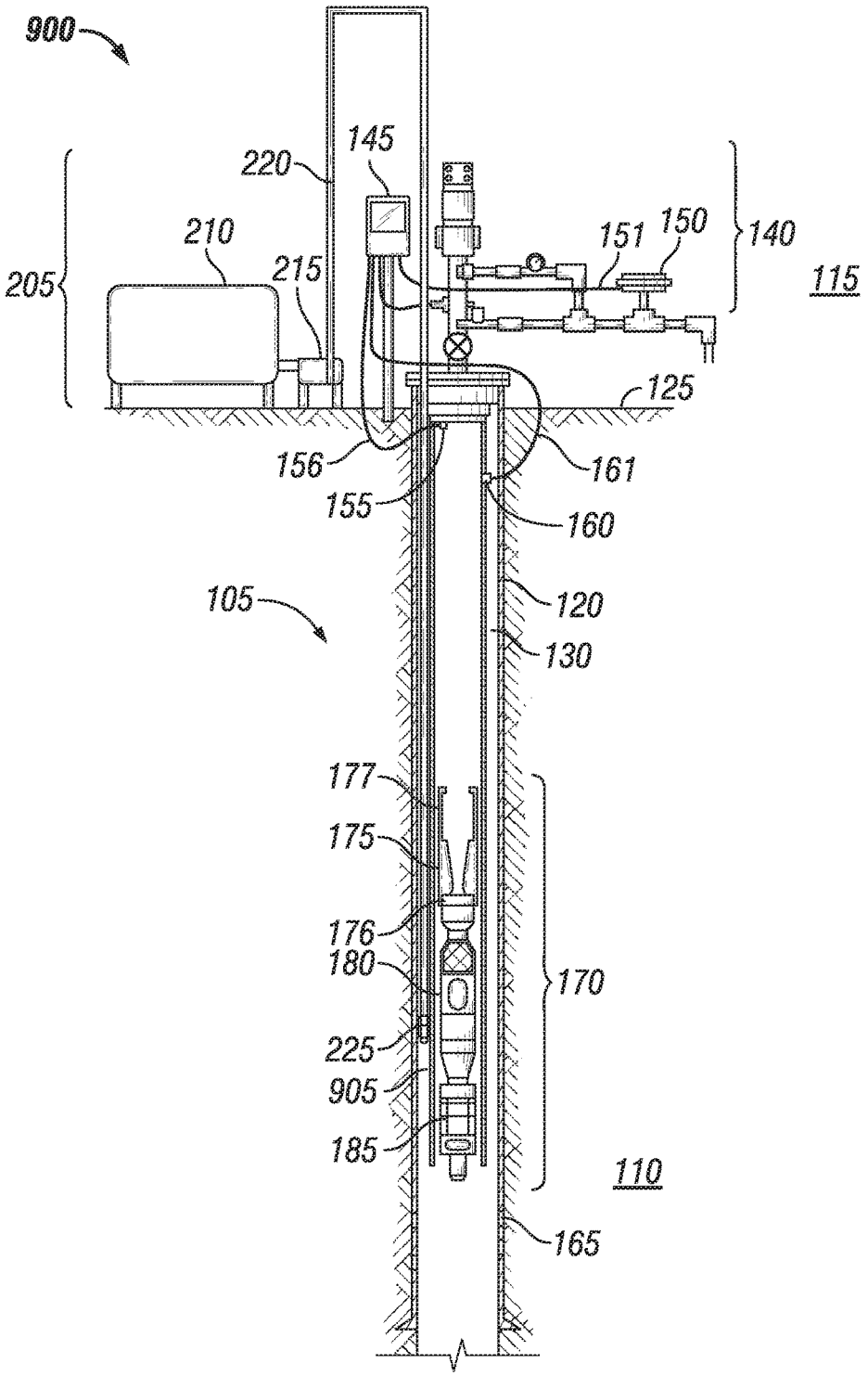
FIG. 9 illustrates one embodiment of a system for deliquefying produced fluid being produced from a well. The system of FIG. 9 is similar to the system of FIG. 2, but FIG. 9 illustrates the capillary tubing and the capillary tubing valve in an annulus between the casing and the production tubing.

Referring to FIG. 9, FIG. 9 illustrates one embodiment of a system 900 for deliquefying the produced fluid 101. The system 900 is similar to the system 200 of FIG. 2, but FIG. 9 illustrates the capillary tubing 220 and the capillary tubing valve 225 in an annulus 905 between the casing 120 and the production tubing 130. As such, the foaming agent may be delivered downstream of the nozzle assembly 170 with three elements, which includes the nozzle 175.

Figure 10:
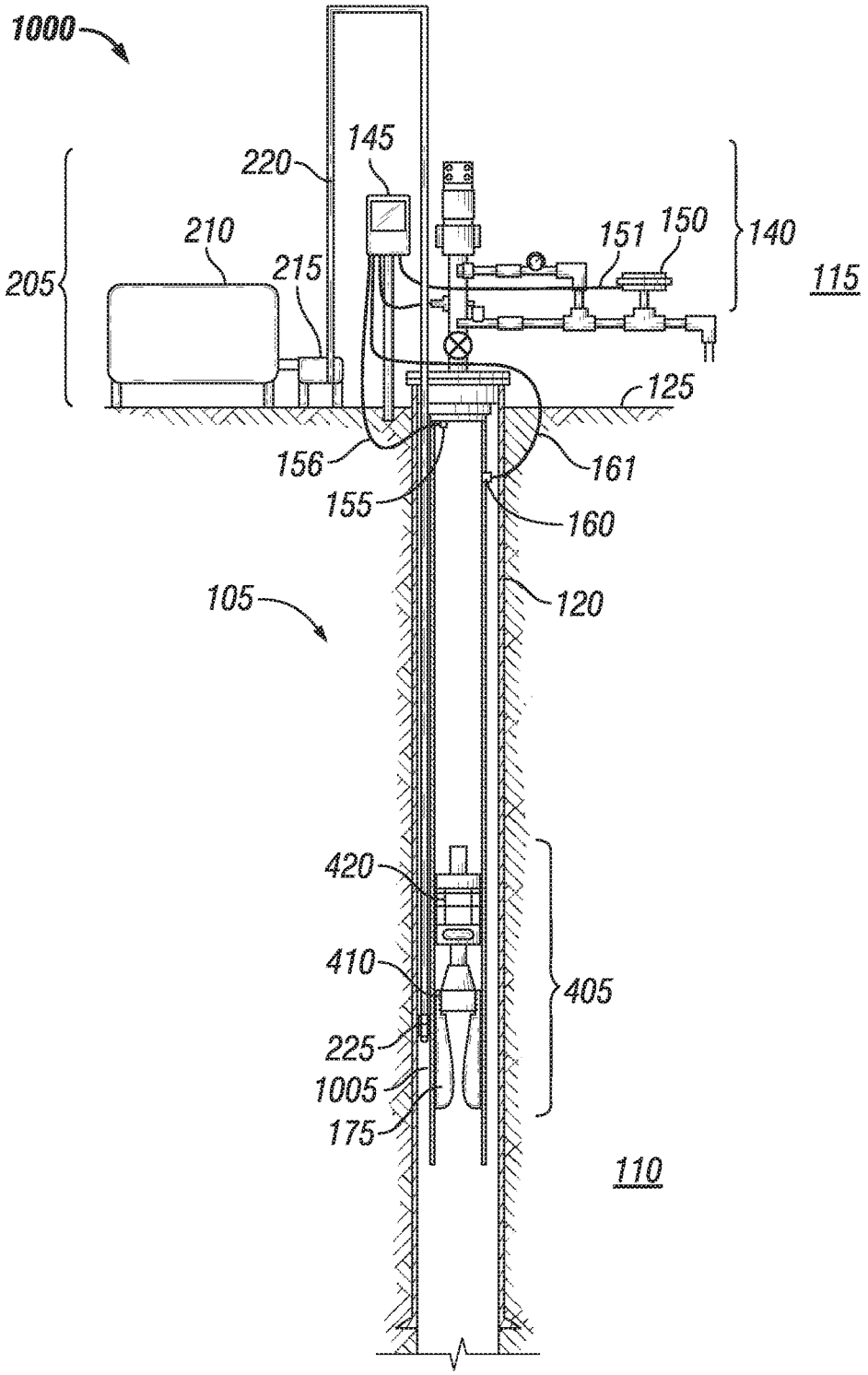
FIG. 10 illustrates one embodiment of a system for deliquefying produced fluid being produced from a well. The system of FIG. 10 is similar to the system of FIG. 5, but FIG. 10 illustrates the capillary tubing and the capillary tubing valve in an annulus between the casing and the production tubing.

Referring to FIG. 10, FIG. 10 illustrates one embodiment of a system 1000 for deliquefying the produced fluid 101. The system 1000 is similar to the system 500 of FIG. 5, but FIG. 10 illustrates the capillary tubing 220 and the capillary tubing valve 225 in an annulus 1005 between the casing 120 and the production tubing 130. As such, the foaming agent may be delivered downstream of the nozzle assembly 405 with two elements, which includes the nozzle 175.

Figure 11A:
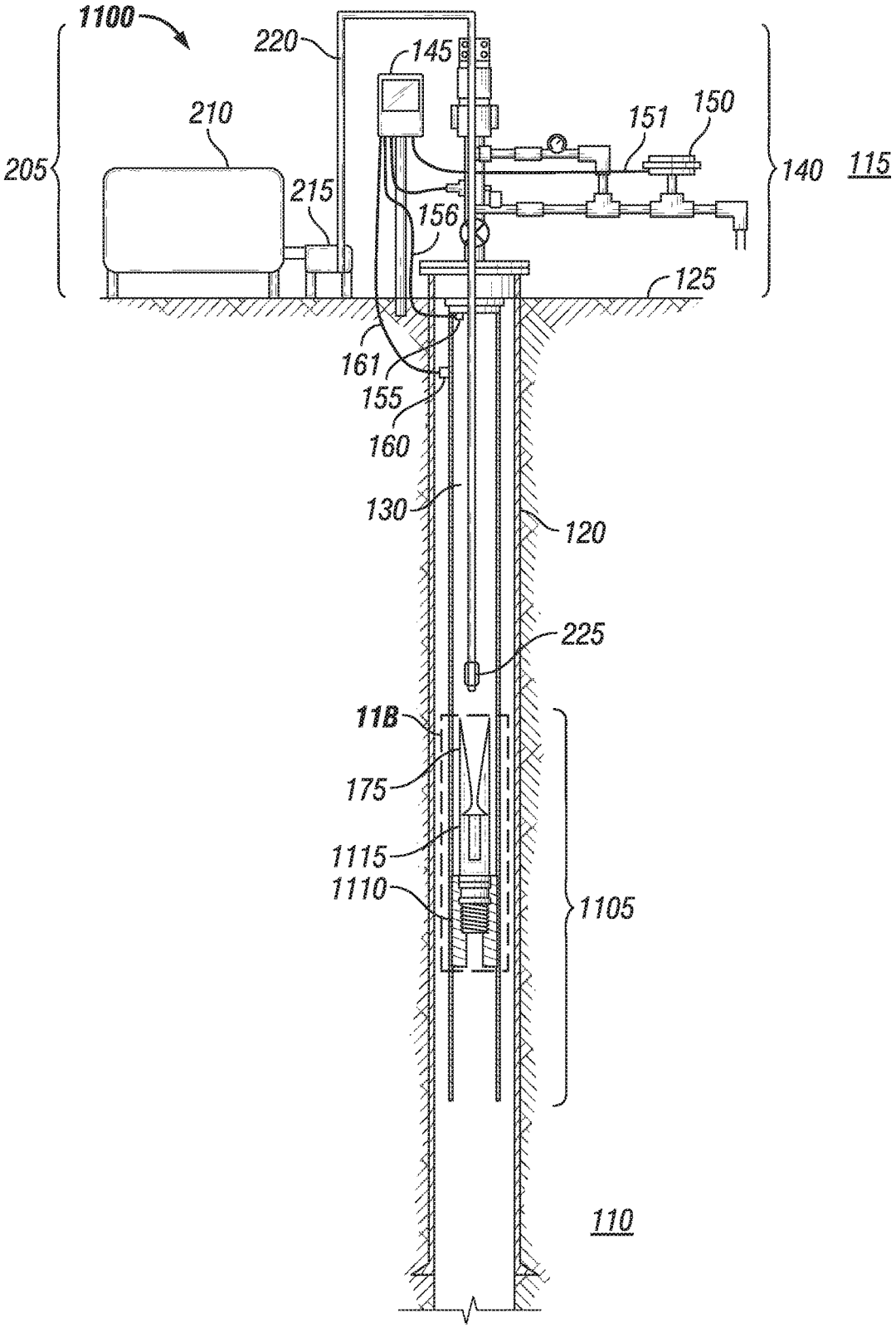
FIG. 11A illustrates one embodiment of a system for deliquefying produced fluid being produced from a well. The system of FIG. 11A is similar to the system of FIG. 5, but FIG. 11A illustrates a different nozzle assembly with two elements as compared to the nozzle assembly of FIG. 4A with two elements, and the order of the two elements is also different.
Figure 11B:
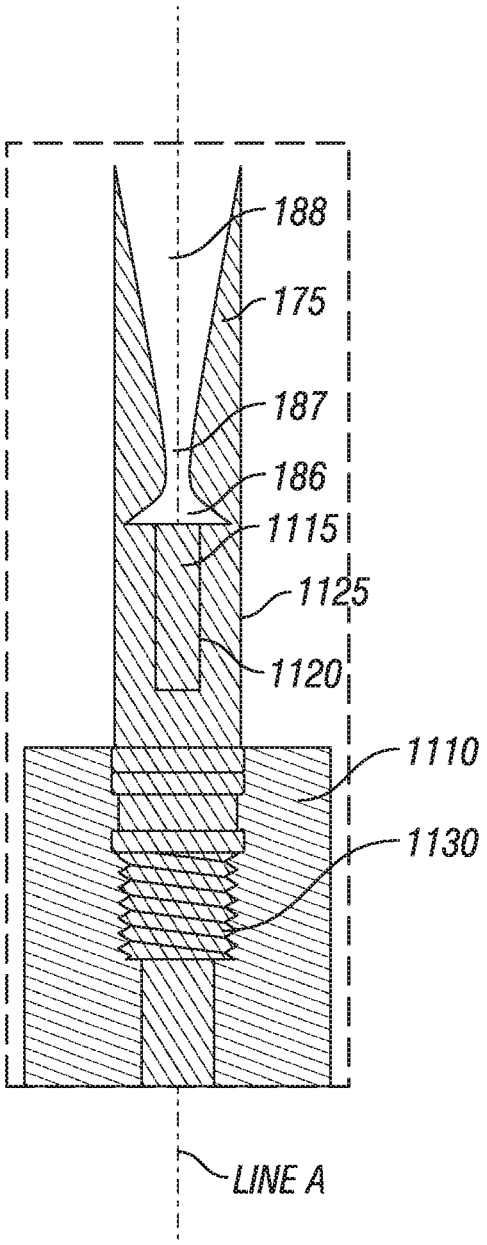
FIG. 11B is an expanded view of the deliquification assembly shown in box 11B in FIG. 11A.

Referring to FIG. 11A, FIG. 11A illustrates one embodiment of a system 1100 for deliquefying the produced fluid 101. The system 1100 is similar to the system 5 of FIG. 5, but FIG. 11A illustrates a different nozzle assembly 1105 with two elements as compared to nozzle assembly 405 with two elements, and the order of the two elements is also different. For example, the nozzle assembly 1105 has a stopper 1110, which may comprise at least one hold down cup. Furthermore, the order of the nozzle assembly 1105 has swapped as compared to the nozzle assembly 405, such that the stopper 1110 is farther away from the surface location 115 in FIG. 11A instead of closer to the surface location 115 as in FIG. 5. Moreover, a tool engagement segment 1115 is proximate the intake 186 of the nozzle 175 for coupling the stopper 1110 and the nozzle 175. As illustrated in FIGS. 11A and 11B, various additional components may also be included in some embodiments, such as at least one gauge 1120, at least one gauge housing 1125, at least one nipple 1130 (e.g., X-nipple), etc. In embodiments, the gauge 1120 measures pressure or flow. In some embodiments, the gauge housing additionally comprises memory configured to store measurements from the gauge. In embodiments, the memory is configured to store at least six months, 8 months, 10 months, or a year of measurements from the gauge. In some embodiments, the gauge and gauge housing are acquired from a commercial source, for example, the gauge and gauge housing could be a Pioneer Petrotech Service (PPS) PPS25XM.

In operation, the produced fluid 101 enters the production tubing 130 from the reservoir 110 (e.g., via the perforations 165) and the produced fluid 101 flows up through the stopper 1110, and then up through the nozzle 175. The stopper 1110 is used to keep the nozzle 175 in place. The produced fluid 101 is deliquefied as it flows through the nozzle 175. Based on the data received from the production tubing pressure sensor 155, the casing pressure sensor 160, the timer (e.g., of the controller 145), or any combination thereof, the controller 145 may close and/or open the motor valve 150 to assist with deliquification of the produced fluid 101.

Those of ordinary skill in the art will appreciate that various modification may be made to the embodiments illustrated in FIGS. 2-11. For example, the nozzle 175 in FIGS. 2-11 may be replaced with any of the nozzles illustrated in FIGS. 12A-12G. Furthermore, the nozzle 175 may have a tool engagement segment proximate to the diffuser, a tool engagement segment proximate to the intake, or both. As another example, the foaming agent may be delivered without use of any capillary tubing valve or simply through the annulus as described above. Furthermore, in some embodiments, the foaming agent may be delivered in the annulus, as well as in the production tubing or the casing. Furthermore, in some embodiments, at least one nozzle may be positioned in the production tubing, the casing, or both. For example, in a well, a first nozzle may be positioned in a portion of the casing without production tubing and a second nozzle may be positioned in the production tubing. Furthermore, in some embodiments, at least one nozzle assembly may be positioned in the production tubing, the casing, or both. For example, in a well, a first nozzle assembly may be positioned in a portion of the casing without production tubing and a second nozzle assembly may be positioned in the production tubing. Furthermore, the above-described apparatuses, systems, and methods can be combined with other production techniques (e.g., velocity or siphon strings, gas lift, wellhead compression, injection of soap sticks or foamers, etc.) For example, more information that may be utilized herein may be found in U.S. Pat.

No. 9,062,538 B2, which is incorporated herein by reference in its entirety. Moreover, the placement and quantity of a nozzle may vary. Moreover, the placement and quantity of a nozzle assembly may vary. For example, FIG. 13 illustrates a diagram 1300 providing guidance on nozzle positioning.

Figure 13:
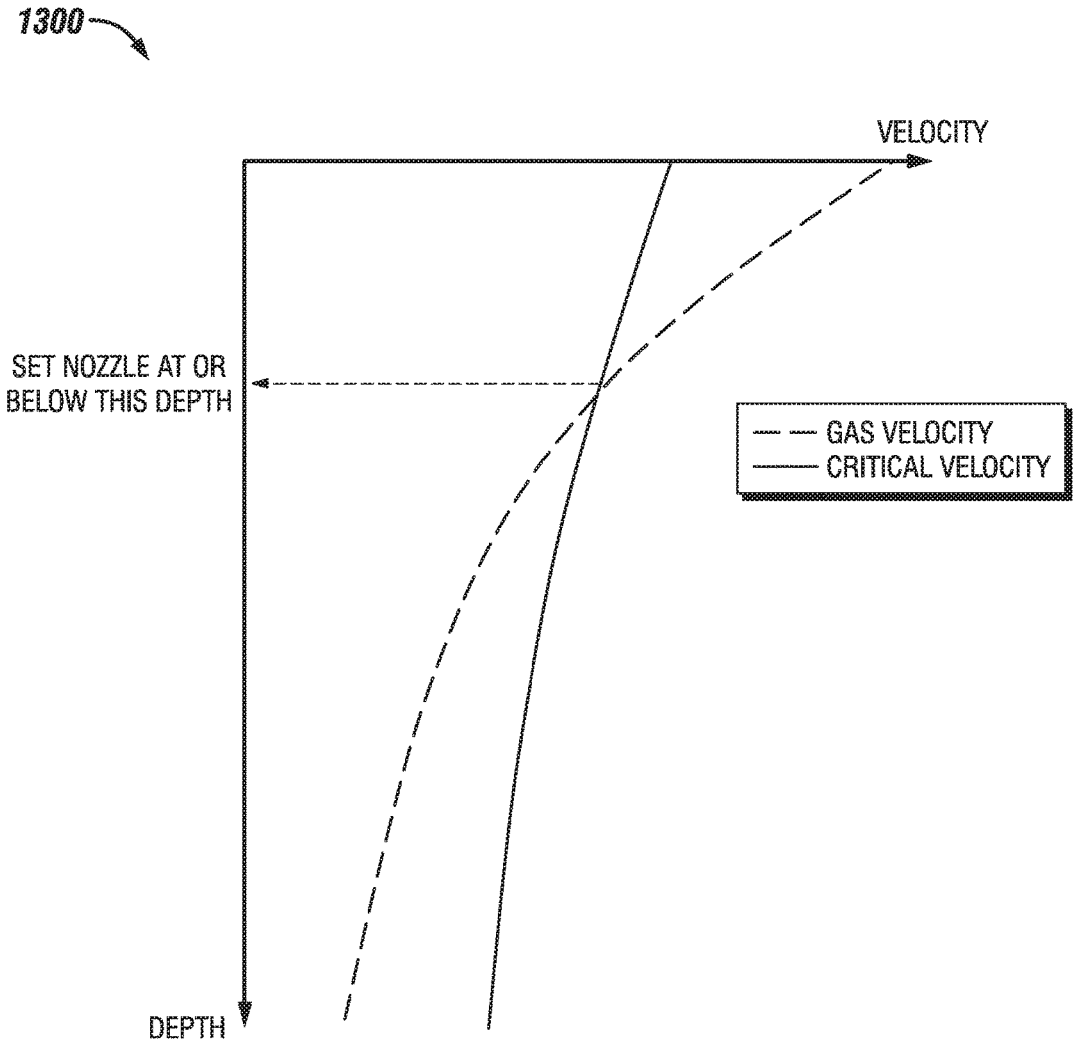
FIG. 13 illustrates a diagram providing guidance on nozzle positioning.

FIG. 13 indicates a nozzle should be positioned at the depth where gas velocity (e.g., of the produced fluid 101 which contains gas) and critical velocity intersect. Critical velocity refers to the minimum produced fluid velocity needed to lift liquids out of the well. Gas velocity may be determined by Schlumberger Nodal Analysis, etc. Critical velocity may be determined by using the Turner equation. FIG. 13 indicates a nozzle should be positioned at the depth where gas velocity and critical velocity intersect. FIG. 13 indicates a nozzle should be positioned below the depth where gas velocity and critical velocity intersect. Thus, FIG. 13 indicates a nozzle should be positioned at or below the depth where gas fluid velocity and critical velocity intersect.

Of note, the liquid level of the produced fluid may be kept below the nozzle (e.g., when the nozzle is alone or as part of the nozzle assembly). Additionally, the liquid level may be kept below the entire nozzle assembly in some embodiments. If the height of the liquid level is a concern, operations may try to lower the liquid level by manipulating the casing pressure or through mechanically removing liquid (swabbing). Furthermore, in some embodiments, the nozzle may be set as deep as possible in the production tubing or the casing because this is where gas velocity first falls below critical velocity. In other words, where gas velocity meets the critical velocity may be the minimum possible depth to consider setting the nozzle in some embodiments.

Various embodiments have been provided herein. For example, embodiments of a system for deliquification of produced fluid being produced from a well are provided herein. In one embodiment, the system comprises a production tubing, a casing, or both that receive the produced fluid from a subterranean reservoir and provide a pathway for transmission of the produced fluid to a surface location. The system also comprises a nozzle disposed within the production tubing, the casing, or both. The nozzle comprises an intake that defines an inlet, a throat proximate to the intake, and a diffuser proximate to the throat. The nozzle includes a passageway extending between the intake and the diffuser such that the produced fluid received by the intake flows through the nozzle via the passageway. The passageway includes a region of decreased cross-sectional area at the throat that reduces the pressure of the produced fluid passing through the nozzle and the produced fluid is deliquefied as it flows through the passageway.

As another example, embodiments of an apparatus for deliquification of produced fluid being produced from a well are provided herein. In one embodiment, the apparatus comprises a nozzle for positioning in a production tubing, a casing, or both. The nozzle comprises an intake that defines an inlet, a throat proximate to the intake, and a diffuser proximate to the throat. The nozzle includes a passageway extending between the intake and the diffuser such that the produced fluid from a subterranean reservoir received by the intake flows through the nozzle via the passageway. The passageway includes a region of decreased cross-sectional area at the throat that reduces the pressure of the produced fluid passing through the nozzle and the produced fluid is deliquefied as it flows through the passageway.

As another example, embodiments of a method for deliquification of a produced fluid being produced from a well are provided herein. The method comprises providing a production tubing, a casing, or both extending from a subterranean reservoir to a surface location. The method also comprises providing a nozzle that comprises an intake that defines an inlet, a throat proximate to the intake, and a diffuser proximate to the throat. The nozzle includes a passageway extending between the intake and the diffuser such that the produced fluid received by the intake flows through the nozzle via the passageway. The passageway includes a region of decreased cross-sectional area at the throat that reduces the pressure of the produced fluid passing through the nozzle and the produced fluid is deliquefied as it flows through the passageway. The method also comprises receiving the produced fluid through the production tubing, the casing, or both along a pathway between the reservoir and the surface location such that the produced fluid passes through the nozzle.

The nozzle and the nozzle assembly may be used to deliquefy produced fluid from gas wells, and gas wells that are free from liquids may be able to produce at higher production rates for a longer period of time. Furthermore, in some embodiments, the nozzle and the nozzle assembly may be used to stabilize oil wells. Stabilized oil wells may be able to produce higher rates with reduced down time. The controller assembly, the foaming assembly, or both may also significantly extend the feasible life and operating range of the nozzle. Additional benefits may also be found by selecting the appropriate setting mechanism for the corresponding application (e.g., offshore, on land, deviated).

The description and illustration of one or more embodiments provided in this application are not intended to limit or restrict the scope of the invention as claimed in any way. The embodiments, examples, and details provided in this disclosure are considered sufficient to convey possession and enable others to make and use the best mode of claimed invention. The claimed invention should not be construed as being limited to any embodiment, example, or detail provided in this application. Regardless whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope. For instance, such other examples are intended to be within the scope of the claims if they have structural or methodological elements that do not differ from the literal language of the claims, or if they include equivalent structural or methodological elements with insubstantial differences from the literal languages of the claims, etc. All citations referred herein are expressly incorporated herein by reference.

The invention claimed is:

1. A system for deliquification of produced fluid comprising gas being produced from a gas well in communication with a subterranean gas reservoir, the system comprising:

a. a production tubing, a casing, or both that receive the produced fluid from the subterranean gas reservoir and provide a pathway for transmission of the produced fluid to a surface location, wherein the production tubing, the casing, or both are disposed within the gas well;

b. a nozzle assembly disposed within the production tubing, the casing, or both, wherein the nozzle assembly comprises:

i. a nozzle comprising an intake that defines an inlet, a throat proximate to the intake, and a diffuser proximate to the throat, wherein the nozzle includes a passageway extending between the intake and the diffuser such that the produced fluid received by the intake flows through the nozzle via the passageway, and wherein the passageway includes a region of decreased cross-sectional area at the throat that reduces the pressure and increases the gas velocity of the produced fluid passing through the nozzle such that the gas flow reaches a speed of sound as the gas flows through the passageway thereby deliquefying the produced fluid, and wherein the nozzle is positioned at or below a depth where gas fluid velocity and critical velocity intersect; and ii. a stopper coupled to the nozzle to keep the nozzle in place in the production tubing, the casing, or both; and c. a controller assembly that comprises a controller, at least one production tubing pressure sensor to provide the controller with pressure data for the production tubing, at least one casing pressure sensor to provide the controller with pressure data for the casing, or both, and a motor valve coupled to the controller to open or close the gas well responsive to the controller depending on the pressure data received by the controller, wherein, if the pressure data is below or exceeds a desired pressure level, the controller is configured to close or open the gas well, respectively, such that the gas velocity of the produced fluid passing through the nozzle is controlled.

2. The system of claim 1, further comprising a sealer coupled to the nozzle by a tool engagement segment to ensure that the produced fluid flows through the nozzle and not around the nozzle.

3. The system of claim 1, wherein the stopper is coupled to the nozzle by a tool engagement segment.

4. The system of claim 1, further comprising a foaming assembly that comprises a tank for storing a foaming agent, a pump coupled to the tank for pumping the foaming agent, and a capillary tubing coupled to the pump and the tank for injecting the foaming agent.

5. The system of claim 4, wherein the foaming agent is injected upstream of the nozzle, downstream of the nozzle, or both.

6. The system of claim 1, further comprising a tool engagement segment proximate to the intake of the nozzle, proximate to the diffuser, or both.

7. The system of claim 2 or 3 or 6, wherein the tool engagement segment comprises a fish neck having a lip for engagement with a wireline tool to facilitate the nozzle assembly being positioned and repositioned at any depth within the production tubing, the casing, or both.

8. The system of claim 1, wherein the nozzle is a convergent-divergent nozzle.

9. The system of claim 1, wherein the diffuser of the nozzle has a conical shape.

10. The system of claim 1, wherein the diffuser of the nozzle comprises at least one bell.

11. The system of claim 1, wherein the diffuser of the nozzle comprises at least one areospike.

12. The system of claim 1, wherein the diffuser of the nozzle comprises a first section shaped in a conical shape or a bell shape, and an adjoining second section shaped in a conical shape, a bell shape, an aerospike shape, or a cylindrical shape with a constant inner diameter.

13. The system of claim 1, further comprising one or more additional nozzles disposed at spaced locations along a length of the production tubing, the casing, or both such that the produced fluid passes successively through each of the nozzles.

14. A method for deliquification of a produced fluid comprising gas being produced from a gas well in communication with a subterranean gas reservoir, the method comprising:

a. providing a nozzle assembly within a production tubing, a casing, or both extending from the subterranean gas reservoir to a surface location and disposed within the gas well, the nozzle assembly comprising:

a nozzle that comprises an intake that defines an inlet, a throat proximate to the intake, and a diffuser proximate to the throat, wherein the nozzle includes a passageway extending between the intake and the diffuser such that the produced fluid received by the intake flows through the nozzle via the passageway, and wherein the passageway includes a region of decreased cross-sectional area at the throat that reduces the pressure and increases the gas velocity of the produced fluid passing through the nozzle such that the gas flow reaches a speed of sound as the gas flows through the passageway, and wherein the nozzle is positioned at or below a depth where gas fluid velocity and critical velocity intersect; and a stopper coupled to the nozzle to keep the nozzle in place in the production tubing, the casing, or both; and a sealer coupled to the nozzle to ensure that the produced fluid flows through the nozzle and not around the nozzle;

b. receiving the produced fluid through the production tubing, the casing, or both along a pathway between the reservoir and the surface location such that at least a portion of the produced fluid passes through the nozzle via the passageway;

c. deliquefying the produced fluid as the produced fluid flows through the passageway;

d. measuring pressure data in the tubing, the casing or both using at least one production tubing pressure sensor, at least one casing pressure sensor, or both coupled to a controller;

e. providing the pressure data to the controller, further coupled to a motor valve for opening and closing the gas well as directed by the controller; and f. opening or closing the gas well, responsive to the controller depending on the pressure data received by the controller, thereby controlling the velocity of the produced fluid.

15. The method of claim 14, wherein the step of providing the nozzle assembly comprises providing a plurality of nozzle assemblies at spaced locations along a length of the production tubing, the casing, or both such that the produced fluid passes successively through each of the nozzle assemblies.

16. The method of claim 14, wherein the stopper is coupled to the nozzle by a tool engagement segment.

17. The method of claim 14, further comprising providing a foaming assembly that comprises a tank for storing a foaming agent, a pump coupled to the tank for pumping the foaming agent, and a capillary tubing coupled to the pump and the tank for injecting the foaming agent.

18. The method of claim 17, further comprising injecting the foaming agent upstream of the nozzle assembly, downstream of the nozzle assembly, or both.

19. The method of claim 17, further comprising injecting the foaming agent into an annulus between the casing and the production tubing.

20. The method of claim 14, wherein the diffuser of the nozzle has a conical shape, a bell shape, or a shape comprising a first section shaped in one of a conical shape or bell shape, and an adjoining second section shaped in a conical shape, bell shape, aerospike shape, or cylindrical shape with a constant inner diameter.

21. The method of claim 14, wherein the nozzle assembly is positioned within the production tubing, the casing, or both proximate to a bottom of the production tubing.

22. The method of claim 14, wherein, if the pressure data is below a desired pressure level, the controller closes the gas well via the motor valve until sufficient pressure is built up in the gas well for the velocity of the produced fluid passing through the nozzle to reach a desired velocity.

23. The method of claim 14, wherein, if the pressure data exceeds a desired pressure level, the controller opens the gas well via the motor valve.

24. The method of claim 14, wherein the gas well is a horizontal well.

25. The method of claim 14, wherein the nozzle assembly further comprises a tool engagement segment comprising a fish neck having a lip for engagement with a wireline tool to facilitate the nozzle assembly being positioned and repositioned at any depth within the production tubing, the casing, or both.

26. The method of claim 25, further comprising repositioning or removing the nozzle assembly by engaging the tool engagement segment using the wireline tool.

* * * * *